United States Patent [19]

Saito et al.

[11] Patent Number: 4,806,989

[45] Date of Patent: Feb. 21, 1989

[54] OPTICAL CORRECTION DEVICE

[75] Inventors: Taku Saito; Yozo Fujii, both of Hachioji, Japan

[73] Assignee: Konishiroku Photo Industry Co., Ltd., Tokyo, Japan

[21] Appl. No.: 46,624

[22] Filed: May 6, 1987

[30] Foreign Application Priority Data

May 14, 1986 [JP] Japan ..... 61-108543
Jan. 23, 1987 [JP] Japan ..... 62-14498

[51] Int. Cl.[4] ..... G03G 15/00

[52] U.S. Cl. ..... 355/55; 355/8; 355/14 E; 355/67; 355/71

[58] Field of Search ..... 355/55, 67, 71, 8, 14 E

[56] References Cited

U.S. PATENT DOCUMENTS

| | | | |
|---|---|---|---|
| 3,967,894 | 7/1976 | Tsilibes | 355/67 X |
| 4,072,413 | 2/1978 | Amess | 355/71 |
| 4,172,658 | 10/1979 | Tani et al. | 355/71 X |
| 4,716,442 | 12/1987 | Yazaki | 355/71 X |

FOREIGN PATENT DOCUMENTS

| | | |
|---|---|---|
| 146630 | 12/1977 | Japan . |
| 156616 | 12/1977 | Japan . |
| 136845 | 10/1979 | Japan . |
| 73767 | 5/1982 | Japan . |
| 92348 | 6/1982 | Japan . |
| 121953 | 7/1982 | Japan . |
| 154265 | 9/1982 | Japan . |
| 80828 | 5/1985 | Japan . |
| 134226 | 7/1985 | Japan . |

*Primary Examiner*—A. C. Prescott
*Assistant Examiner*—Jane Lau
*Attorney, Agent, or Firm*—Finnegan, Henderson, Farabow, Garrett, & Dunner

[57] ABSTRACT

The present invention provides an optical correction device capable of correcting an exposure distribution so as to be flat at an image receiving surface such as a photoreceptor of copying machine, in spite of varying a projection magnification of original image on the image receiving surface. Additionally, the optical correction device can correct an exposure amount on the image receiving surface so as to be substantially same level throughout all available magnifications.

16 Claims, 21 Drawing Sheets

FIG. 3 CUT OFF LIGHT AMOUNT : MAXIMUM
(MAGNIFICATION : MINIMUM)
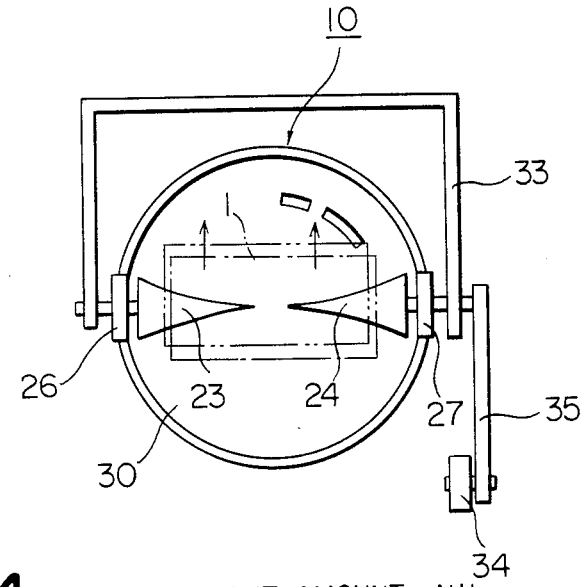
FIG. 4 CUT OFF LIGHT AMOUNT : NIL
(MAGNIFICATION : MAXIMUM)
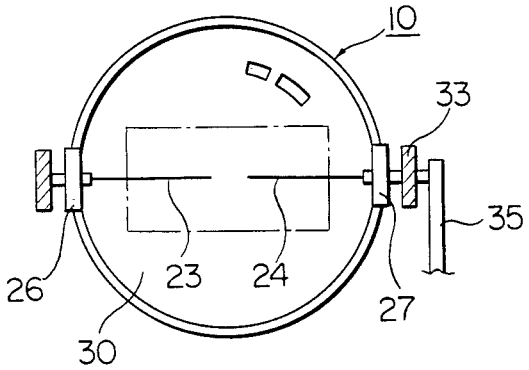

$a = f(1 + 1/m)$ ∴ f : LENSE FOCAL LENGTH $b = f(1 + m)$ m : MAGNIFICATION

WITHOUT LIGHT DISTRIBUTION CORRECTION

WITH LIGHT DISTRIBUTION CORRECTION

FIG. 19 CUT OFF LIGHT AMOUNT : MAXIMUM
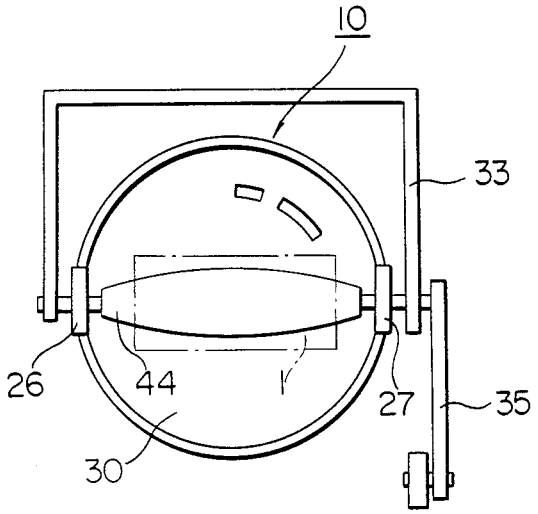
FIG. 20 CUT OFF LIGHT AMOUNT : NIL
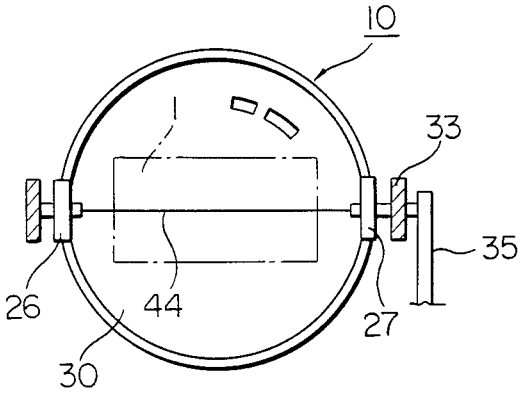

FIG. 24 CUT OFF LIGHT AMOUNT OF REDUCING SIDE : MAXIMUM
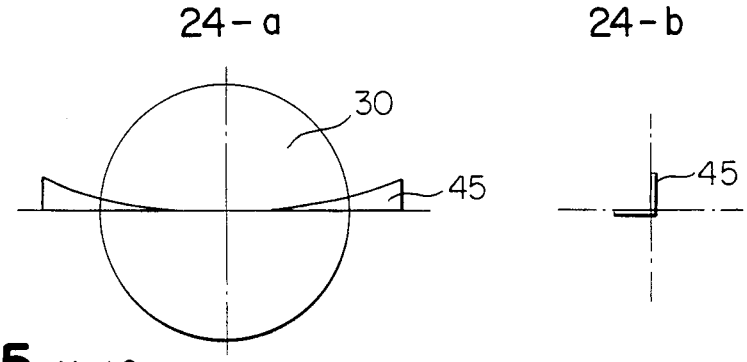
FIG. 25 M = 1.0
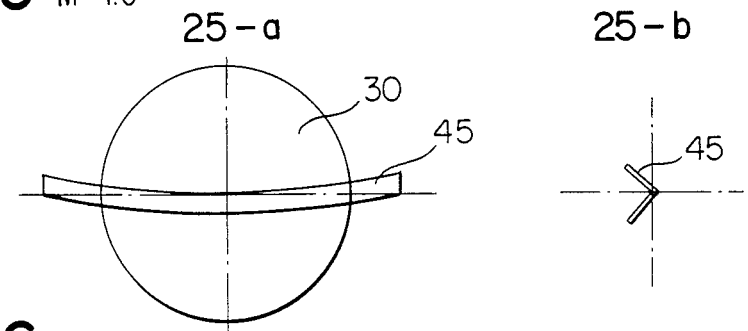
FIG. 26 CUT OFF LIGHT AMOUNT OF ENLARGING SIDE : MAXIMUM
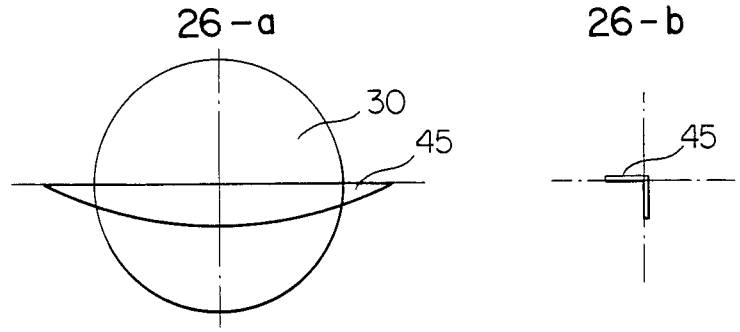
FIG. 27
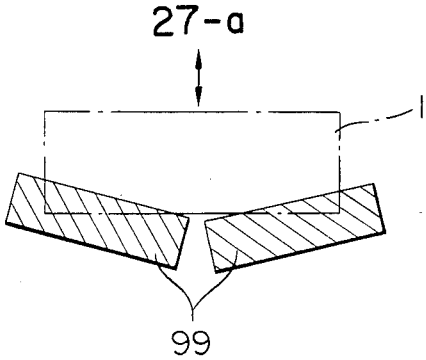

27-b

FIG. 29
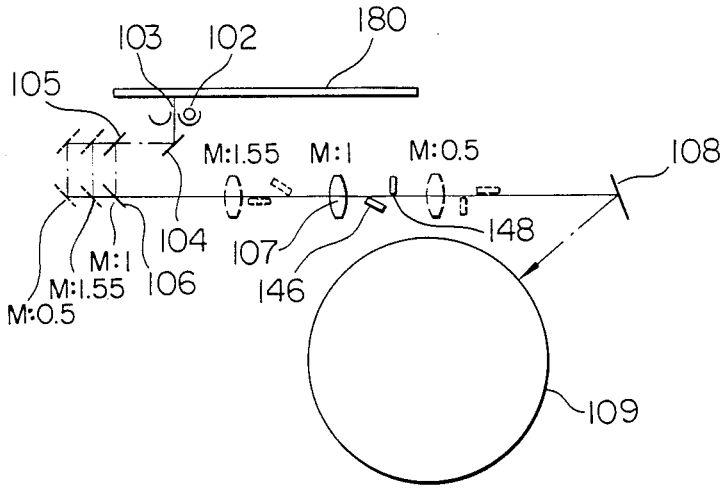
FIG. 30
30-(a)
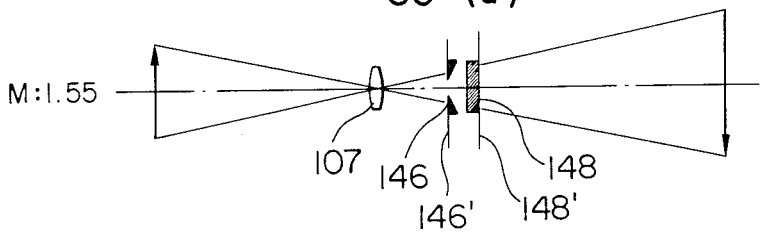
30-(b)
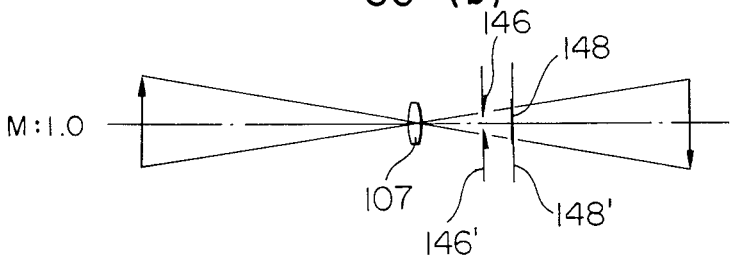
30-(c)
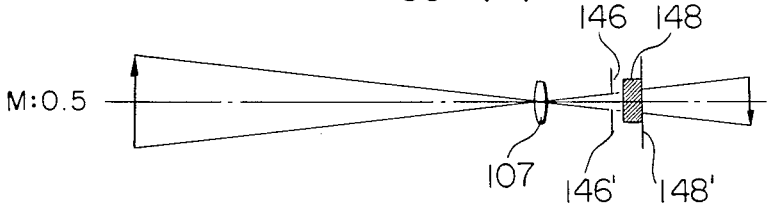

FIG. 33
33-(a)
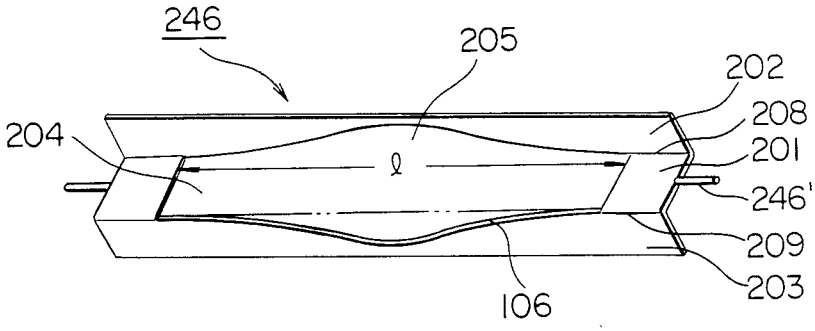
33-(b)
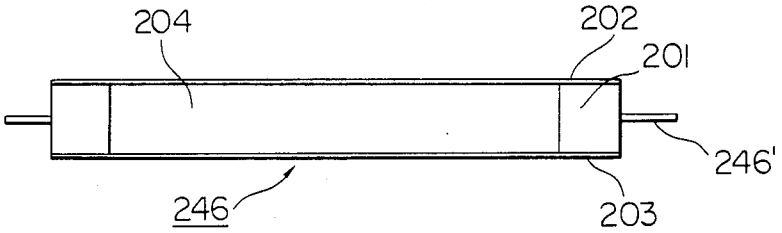
33-(c)
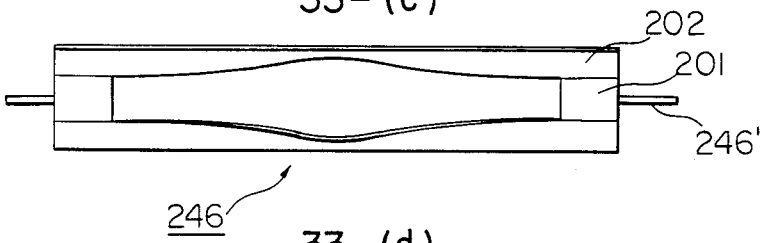
33-(d)
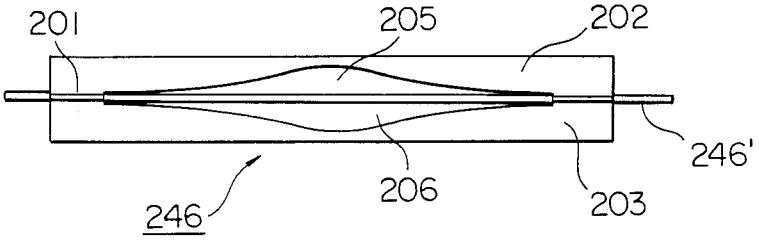

OPTICAL CORRECTION DEVICE

BACKGROUND OF THE INVENTION

The present invention relates to a mechanism for correcting light distribution and light amount applied to a projecting mechanism in a copying machine.

In a projecting mechanism in an electro-photographic copying machine a lens is indispensable for forming an image projected on a photo-sensitive member as an image-carrier. However, the lens has the characteristic of a "$\cos^4\theta$ low" (whose details will be described later) that "a luminous flux density at an image point aside from an optical axis is reduced in proportion to $\cos^4\theta$ of the luminous flux density at an image point on the optical axis."

Accordingly, an unevenness of exposure amount occurs, i.e., the image-forming surface of the photo-sensitive member shows a bright exposure distribution in the vicinity of the center of the optical axis and a dark exposure distribution in the peripheral area thereof.

According to the present invention, the distribution of luminous flux density on a cross section of the optical path vertical to the optical axis is herein after referred to as light distribution. Exposure amount is expressed by the product of the quantity of luminous flux incident upon an image-forming surface (photo-sensitive surface) from a light source per a unit area and an exposure time, namely, lux.sec (CMS).

In order to solve the above-described problem, electrophotographic copying machine capable of varying projection magnification, as disclosed in Japanese Patent Publication Open to Public Inspection No. 146630/1977 (hereinafter referred to as Japanese Patent O.P.I. Publication), one side of a slit as an optical path regulating means is provided so as to be moved forward and backward relative to an optical path so that light distribution is controlled. Japanese Patent O.P.I. Publication No. 73767/1982 disclosed an optical cut off means which provided in addition to a slit so as to be moved forward and backward perpendicular to an optical axis of a lens so that light distribution is controlled.

However, since the optical cut off means capable of going forward and backward relative to the optical path has a fixed shape, these mechanisms are incapable of achieving a superior light distribution correction for all of a large number of projection magnifications. In particular, if there is a region where an optical cut off plate does not exist in the longitudinal direction of the cross section of the optical path formed by the slit, i.e., the optical cut off amount is discontinuous in the longitudinal direction, portions having much light amount are locally formed.

In addition, if an optical path 1 is shifted up and down (in a direction shown by an arrow in FIG. 27) relative to an optical cut off means 99, as shown in FIG. 27, the out offlight amount is remarkably changed.

Furthermore, since a magnification is minified, the cross sectional shape of an optical path is reduced in both its width and length, the optical cut off means must move by the minified amount and further by the quantity required for light distribution correction, which causes the mechanism to be complicated.

Besides, when a reduction magnification is relatively small, the cross sectional shape of the optical path is reduced in both its width and length. In order to accomplish a reasonable light distribution correction, the movement quantity of the optical cut off means must be more accurate than that in an equal size copying and a magnified copying.

In addition, in a mechanism of which an optical cut off means moves linearly, a link mechanism provided with a guide rail and many knots is required, and as such, the construction is complicated.

Furthermore, since conventional light distribution correction mechanisms are always under a partially optical cut off condition, light radiated from a light source is not effectively utilized. Hence uneconomical.

The mechanisms having the above-described problems have been proposed in Japanese Patent O.P.I. Publication No. 136845/1979, Japanese Patent O.P.I. Publication No. 92348/1982, Japanese Patent O.P.I. Publication No. 154265/1982, Japanese Patent O.P.I. Publication No. 134226/1985, Japanese Patent O.P.I. Publication No. 80828/1985 and the like in addition to the above described Japanese Patent O.P.I. Publication Nos. 146630/1977 and 73767/1982.

On the other hand, an optical correction device, in which a rectangular optical cut off plate is provided so as to be at a right angle with an optical axis and the optical cut off plate is adapted to be rotatable in front and rear directions of the optical axis, has been proposed in Japanese Utility Model Open to Public Inspection Publication No. 121953/1982. This art is advantageous in that light amount is hardly lost when light is not cut off, but disadvantageous in that light distribution correction can not be favorably carried out.

In addition to the above-described problem of correcting the unevenness of the light distribution on the same cross section perpendicular to the optical path, there is further a problem that an exposure amount on a photoreceptor fluctuates depending on a variation of a selected magnification as stated in Japan Patent O.P.I. Publication No. 156616/1977.

Namely, due to the reasons why, according to the variation of the magnification, the projected size of the original on the photoreceptor is varied, and the scanning speed for the original is also varied if assuming a photoreceptor speed being constant, the relavant exposure amount on the photoreceptor is varied in accordance with the variation of the magnification as shown in FIG. 27-*b*.

FIG. 27-*b* represents the ratio of exposure amount of respective magnification to that of equal size magnification ($m=1.0$).

It may be well understood from this drawing if comparing with the exposure amount of the equal size magnification, that of the reducing and enlarging magnification have indications respectively the reducing tendency.

For the purposes of maintaining the exposure amount at constant in spite of the variation of the magnification, it may be considered to change the light amount of the light source in accordance with the variation or to change the speed of the photoreceptor.

However, there is a disadvantage that these methods cause the apparatus to be complicated.

As a method of regulating an exposure amount, Japanese Utility Model O.P.I. Publication disclosed to use two pieces of plates which are pivotally connected around a shaft, arranged the one of them being at upper side of the shaft and the other one being at lower side, have symmetrically shaped-opening with each other across the shaft and form a slit by being combined the respective openings.

In the above-mentioned method, both corrections for light distribution and exposure amount may be tried to be carried out simultaneously by inclining the two pieces plates at a same turning angle around the shaft.

However, the magnifications required to be corrected its light distribution may be varied depending on the given light distribution of the light source, while the magnifications required to be corrected its exposure amount may be determined, without the dependence on the light distribution of the light source, in accordance with the characteristics in which the exposure amount may show its peak value at the equal size magnification and decrease its value at both sides of the peak point corresponding to the decreasing of the reducing magnification and the increasing of the enlarging magnification.

Therefore, when varying the magnification, it may be difficult to attain a sufficient correction for both light distribution and exposure amount according to the above-mentioned method, from the view of performing the both correction simultaneously.

SUMMARY OF THE INVENTION

It is an object of the present invention to provide an optical correction device having a simple construction, which permits sufficient light distribution correction and light amount correction for varied projection magnifications.

In order to carry out a favorable light distribution correction, an optical cut off means rotatable in an inner region in the width direction (corresponding to the slit width direction) of the cross section of an optical path is provided in the optical path whose cross section is regulated to a slit shape by an optical path regulating means.

An image projection mechanism according to the present invention having a light source for illuminating an original draft, an optical path regulating means provided with a slit for regulating the cross sectional shape of an optical path of an image light from the original draft, an image carrier (an image-forming member) for carrying an image imparted by the image light and an image-forming lens provided in the optical path between the original draft and the image carrier comprises an optical cut off means, formed of a thin plate, which rotates in a direction crossing an optical axis of optical path and about an axis provided along the lengthwise direction of the cross section of the optical path (corresponding to the longitudinal direction of the slit), and is ununiformly changed in its length (which corresponds to the width of the optical cut off means) in the width direction of the cross section of the optical path and is arranged in the optical path whose cross section is regulated to a long and narrow slit shape by the optical path regulating means.

According to the present invention, in order to provide a correction mechanism capable of permitting light amount correction, namely, elimination of light amount difference in addition to the light distribution correction for various projection magnifications, a projection mechanism is provided with an optical path regulating means having a slit for regulating the cross section of a light reflected from or passed through an original draft and a lens for forming an image of the original draft, wherein distribution controlling means and a light amount controlling means are provided in an optical path so as to be rotatable in an inner region in the longitudinal direction of the cross section of the optical path whose cross section is regulated to a rectangle or a shape similar to that by the optical path regulating means.

BRIEF DESCRIPTION OF THE DRAWINGS

FIG. 3 is a front view showing said correction mechanism at the largest optical cut off (the smallest magnification) in the preferred embodiment 1;

FIG. 4 is a front view showing said correction mechanism at the no-optical cut off (the largest magnification) in the preferred embodiment 1;

FIG. 19 is a front view showing a light distribution correction mechanism according to the preferred embodiment 2 at the largest optical cut off (the largest magnification);

FIG. 20 is a front view showing the light distribution correction mechanism according to the preferred embodiment 2 at the no-optical cut off (the smallest magnification);

FIG. 24 (*a*) is a front view showing an angular state of the optical cut off plate according to the preferred embodiment 3 at the smallest magnification;

FIG. 25 (*a*) is a front view showing an angular state of the optical cut off plate according to the preferred embodiment 3 at in an equal-size magnification copying;

FIG. 25 (*b*) is a side view of FIG. 25 (*a*);

FIG. 26 (*a*) is a front view showing an angular state of the optical cut off plate according to the preferred embodiment 3 at the largest magnification;

FIG. 26 (*b*) is a side view of FIG. 26 (*a*);

FIG. 27-*b* amount ratio characteristic diagram;

FIG. 29 is a schematic diagram showing related portions of an image-forming device with one preferred embodiment according to the present invention incorporated;

FIGS. 30 (*a*), (*b*), (*c*) is a positional relation diagram among a slit picture, a projection lens, a light distribution controlling means, a light amount controlling means and an image-forming surface at an enlarged magnification copying, an equal-size magnification copying and a reduced magnification copying;

FIG. 31 (*a'*) is a diagram showing the provision of a light distribution controlling means with the mechanism shown in FIG. 4 (*a*);

FIG. 31 (*b*) is a diagram showing that a luminous flus density of a light reflected from an original draft is flattened;

FIG. 31 (*c*) is a diagram showing an exposure amount distribution at an image-forming position in the case of FIG. 31 (*b*);

FIG. 31 (*d*) is a diagram showing that the luminous flux density of the light reflected from the manuscript is increased at an end portion;

FIG. 31 (*e*) is a diagram showing an exposure amount distribution on an image-forming surface in the case of FIG. 31 (*d*);

FIG. 33 (*a*) is a perspective view showing a second optical path regulating means;

FIG. 33 (*b*) is a projection drawing showing a shape of an optical path regulating window provided vertically to an optical axis at the enlarged magnification copying;

FIG. 33 (*c*) is a projection drawing showing a shape of the optical path regulating window provided vertically to the optical axis at the equal-size magnification copying;

FIG. 33 (*d*) is a projecting drawing showing a shape of the optical path regulating window provided vertically to the optical axis at a reduced magnification copying.

DETAILED DESCRIPTION OF THE INVENTION

EXAMPLE 1

Figure 1:
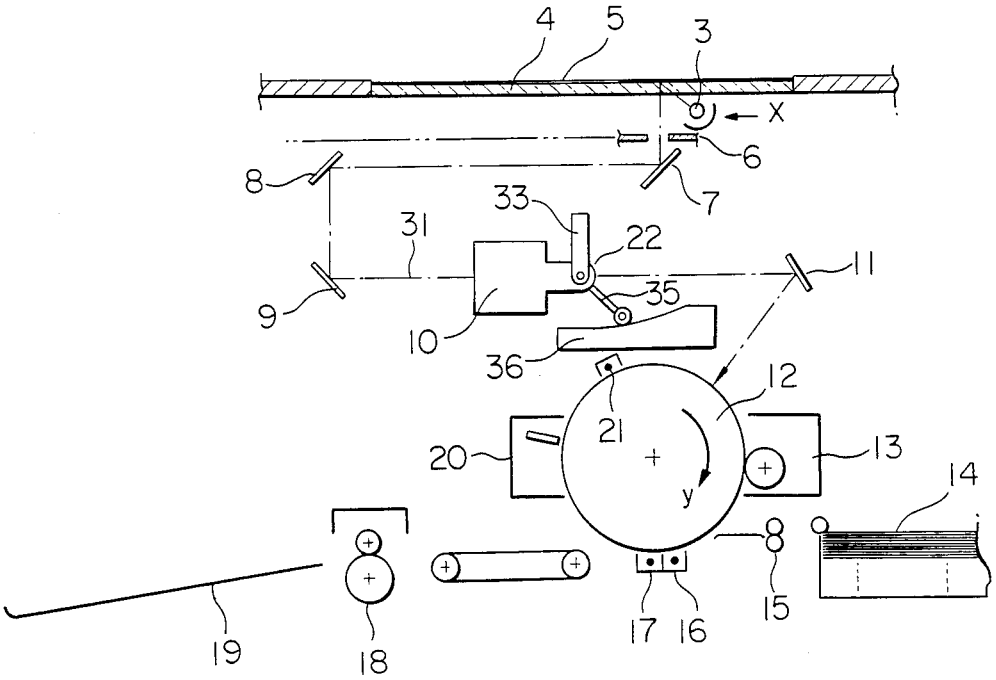
FIG. 1 is a schematic diagram showing a copying machine to which the present invention was applied.
Figure 2:
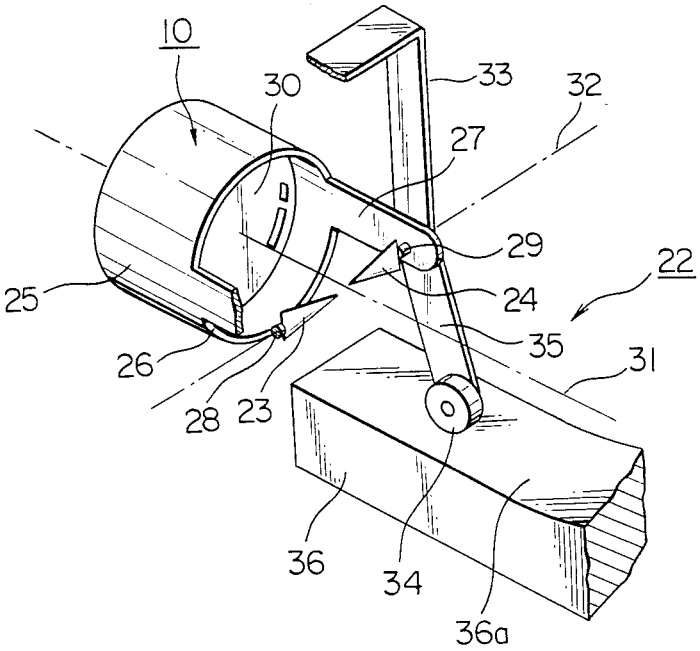
FIG. 2 is a perspective view showing a light distribution correction according to a preferred embodiment 1.

A light distribution correction mechanism according to the present invention will be described hereinafter with reference to preferred embodiments in which it is incorporated in a magnification-variable electro-photographic copying machine. FIG. 1 is a schematic diagram showing a magnification-variable copying machine. A light transmitted from a rod shaped (perpendicular to the drawing) light source 3 carrying out an exposure and scanning in a direction as shown by an arrow x is reflected by an original draft 5 placed on a platen glass 4. The reflected light (image light) carrying the original draft image thereon passes through a slit plate 6 which acts as an optical path regulating means and then, changes the optical path at mirrors 7 to 9. Thereafter, the light passes through an image-forming lens mechanism 10 and then, turns the optical path again at a mirror 11. The light is then allowed to reach a photo-sensitive drum 12 which acts as an image carrier to form an electrostatic latent image on the photo-sensitive drum 12.

The photo-sensitive drum 12 rotates in the direction shown by an arrow y in synchronization with the scanning by the light source 3. The electrostatic latent image is subjected to a toner-development in a developing device 13 and when a transfer paper supplied from a paper-supplying portion 14 is transported to a transfer electrode 16 by a registration roller 15. A toner image is transferred to the transfer paper by means of a transfer electrode 16. And, this transfer paper is separated from the photo-sensitive drum 12 by means of a separation electrode 17 and transported to a thermal fixation roller 18 where the toner image is fixed and the paper is discharged onto a paper-discharging tray 19. Reference numeral 20 designates a cleaning portion. Reference numeral 21 designates an electrifying electrode.

In this copying machine, upon changing a copying magnification, the lens mechanism 10 and the mirrors 8, 9 are moved to appropriate positions. In the present preferred embodiment, special light distribution characteristics are given to the light source 3, as will be described later, and the lens mechanism 10 is provided with a light distribution correction mechanism 22. When the magnification is changed, this light distribution correction mechanism 22 is operated to carry out a light distribution correction disclosed in the present specification This light distribution correction mechanism 22 comprises two optical cut off plates 23, 24 composed of (for example 0.4 mm thick) wedge-shaped metal plates. The optical cut off plates 23, 24 are subjected to black frosting treatment on the surface thereof. These optical cut off plates 23, 24 are rotatably mounted by means of axles 28 and 29 on arms 26, 27 extending from a lens-holder 25 of the lens mechanism 10 in a direction of an optical axis 31. The ends thereof may stand face to face with a distance therebetween. And, a rotation center of the optical cut off plates 23, 24 is an axis 32 perpendicular to the optical axis 31 of a lens 30 in the lens mechanism 10 and parallel to the central axis in the longitudinal direction (direction perpendicular to the drawing) of the slit in the slit plate 6. These optical cut off plates 23, 24 are connected with each other by means of a connecting arm 33 so as to be rotatable in an interlocked manner and connected with an arm 35 provided with a cam follower 34 at the end thereof. Reference numeral 36 designates a cam fixedly mounted on the copying machine so that the cam follower 34 may be always engaged with a cam surface 36*a*. Accordingly, upon moving the lens mechanism 10 along the optical axis 31 to change a magnification, the arms 33, 35 are rotated by the operation of the cam, so that the inclination angles of the optical cut off plates 23, 24 are changed. As a result, the shapes of the optical cut off plates projected on the surface perpendicular to the optical axis 31 are changed.

And, when the optical cut off plates 23, 24 are rotated such that the surfaces thereof stand vertically to the optical axis 31 of the optical path 1, such a state as shown in FIG. 3 is brought about, with the result that luminous fluxes on both sides of the optical path 1 are cut off. In addition, when they are rotated so that the surfaces thereof may be parallel to the optical axis 31, such a state as shown in FIG. 4 is presented and the thin optical cut off plates 23, 24 hardly cut off a luminous flux.

Figure 5:
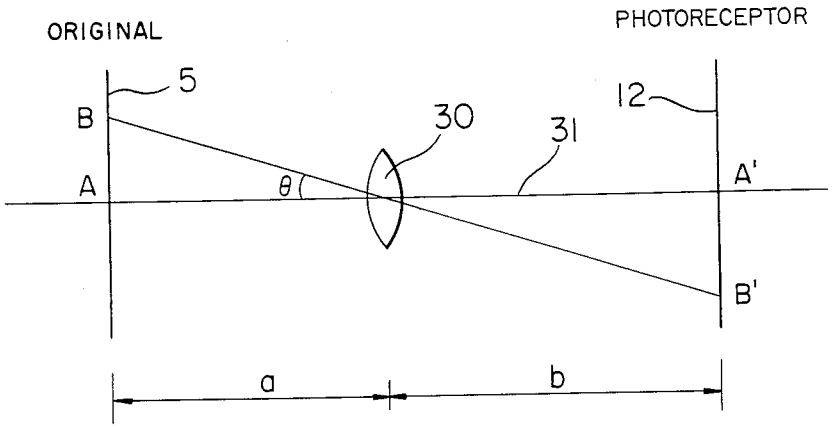
FIG. 5 is a diagram showing a "$\cos^4\theta$law"

As to the light distribution of the light source, the above-described "$\cos^4\theta$ law" is explained again hereafter. Referring to FIG. 5, when an image of the original draft 5 is formed on the photo-sensitive member 12 disposed with a distance b from the lens 30, by means of the lens 30 disposed with a distance a from the original draft 5, the exposure amount at a point B' on the photo sensitive member 12 is reduced by $\cos^4\theta$ ($<1$) times that at point A' in which $\theta$ is the angle formed between the optical axis 31 of the lens 30 and the light incident upon the lens 30, that is, the exposure amount at point B' is smaller than that at point A' which is the point where the light reflected from point A (on the optical axis 31) on the original draft 5. In short, in the equalsize magnification copying the exposure amount projected on the photo-sensitive member 12 at the point B' is reduced in proportion to $\cos^4\theta$ with an increase of the distance between the point B and the optical axis 31.

In addition, the distances a and b are given by the following equations (1), (2), assuming that a focal distance of the lens 30 is f and a magnification of the lens 30 is m:

$$a=f(1+1/m) \quad (1)$$

$$b=f(1+m) \quad (2)$$

According to the present preferred embodiment, the light distribution of the light source 3 (optically equivalent to the original draft 5 in this example) is set so that the exposure amount distribution of the photo-sensitive member 12 after passing the lens 30 may be flattened without cutting off luminous fluxes at a certain magnification.

As described above, the distance a between the original draft 5 and the lens 30 is given by the equation (1). The value of a is reduced with an increase of the magnification m and the lens 30 approaches nearest the original draft 5 at the maximum magnification. Accordingly, in this case the angle $\theta$ is most increased and the reduction of the luminous flux density in the peripheral area due to the "$\cos^4\theta$ law" is most remarkable at this maximum magnification.

Correspondingly, if the maximum value in the variable magnification range of the copying machine is selected as the "certain magnification" and the light distribution of the light source 3 is so prepared in advance that the luminous flux density in the peripheral area, which is distant from the optical axis 31 of the photo-sensitive member 12, is just large enough as well as center area without cutting off luminous fluxes at the maximum magnification, the luminous flux density in the peripheral area increases with a reduction of the magnification, so that it is necessary to flatten the exposure distribution on the surface of the photo-sensitive member 12 by optically cutting off the increase of the luminous flux density in the peripheral area by means of the optical cut off plates 23, 24, and correcting the luminous flux density in the peripheral area to the same extent as that of the optical axis 31.

Figure 6:
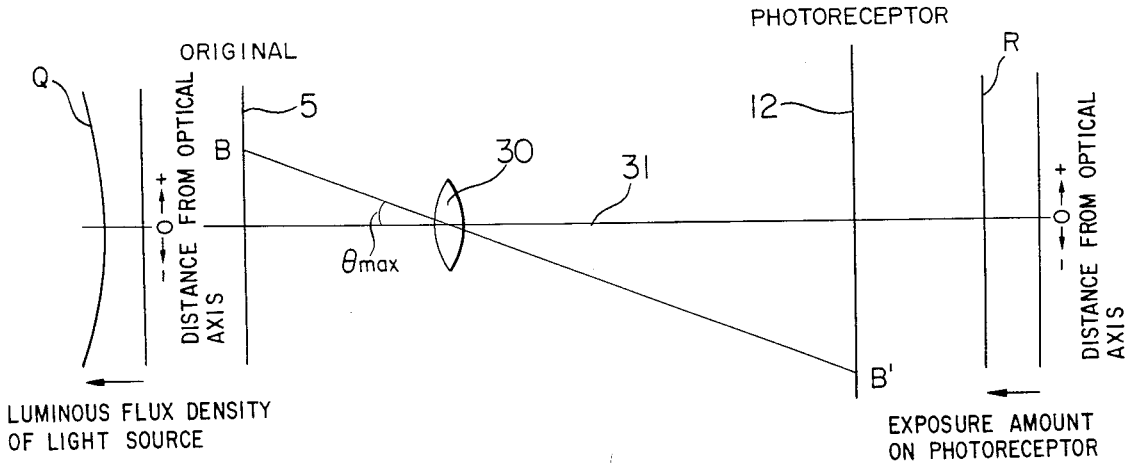
FIG. 6 is a diagram showing a light distribution of a light source in the preferred embodiment 1.

One example of the light distribution set in the above described manner is shown in FIG. 6. A curve Q is light distribution characteristics (symmetric relative to the optical axis 31) of the light source 3 (the manuscript 5), a straight line R being exposure distribution characteristics of the photo-sensitive member 12. The exposure amount on the surface of the photo-sensitive member 12 is constant regardless of the distance (within the predetermined range) from the optical axis 31 by selecting the light distribution characteristics that the luminous flux irradiated from the center of the optical axis 31 of the light source 3 is minimum in amount (which is, however, just large enough amount of luminous flux to obtain a sufficient exposure amount on the optical axis of the photo-sensitive member 12) and the irradiated luminous fluxes are increased in amount in proportion to the distance outward from the center of the optical axis 31.

Here, a method for giving a predetermined light distribution characteristics in a light source is described below.

Figure 8:
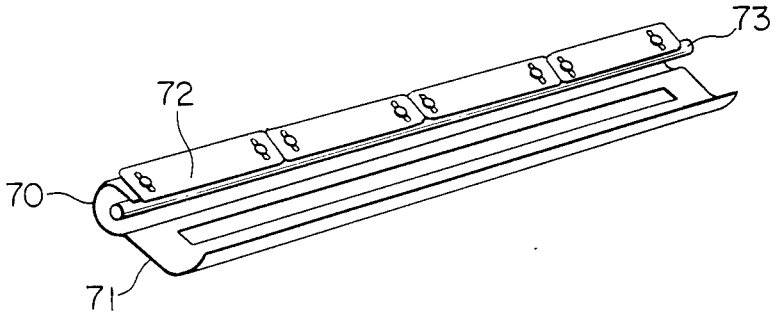
FIG. 8 is a perspective view showing a light source.
Figure 9:
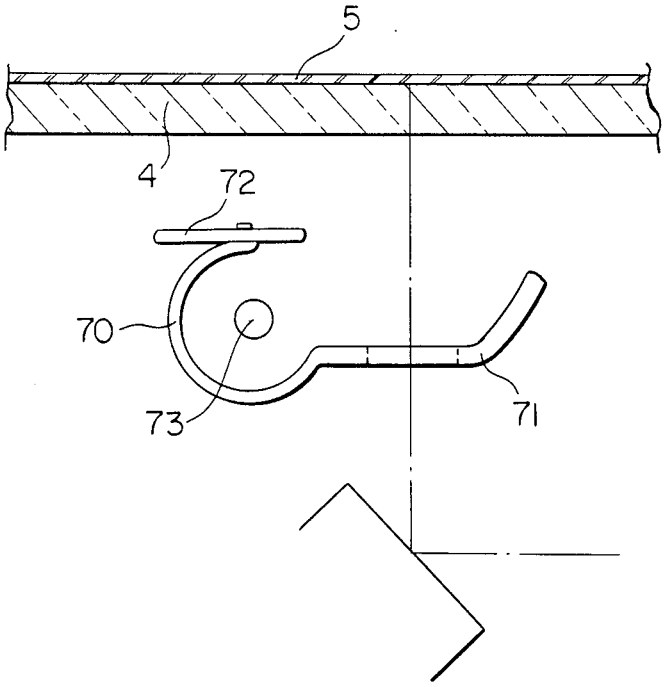
FIG. 9 is a sectional view of FIG. 8.

As shown in FIGS. 8 and 9, the light source portion comprises a lamp 73, a reflecting cover 70 and a light source light distribution-adjusting means 72. In the preferred embodiment illustrated in FIGS. 8 and 9 an optical path regulating means 71 provided with a slit for making the optical path of the reflected light from the original draft a predetermined sectional shape is formed integrally with the reflecting cover 70 in addition to this light source portion.

In order to establish the predetermined light distribution characteristics in the light source, the lamp 73 having the predetermined light distribution characteristics is used. In this case, it is not specially required to provide the light source light distribution-adjusting means 72.

When the lamp 73 having the flattened light distribution is used, the light source light distribution-adjusting means 72 mounted on the reflecting cover 70 through a long hole may be adjusted in the mounted position to obtain the predetermined light source light distribution characteristics.

In addition, the lamp 73 having the appointed light source light distribution characteristics and the light source light distribution-adjusting means 72 are used in combination to finely adjust the fluctuation of the light distribution of the lamp 73 by means of the light source light source light distribution characteristics can be obtained.

In this case, since the lamp 73 having the predetermined light source light distribution characteristics is used, the light amount is not lost. Accordingly, the use of this method is preferable.

Figure 18:
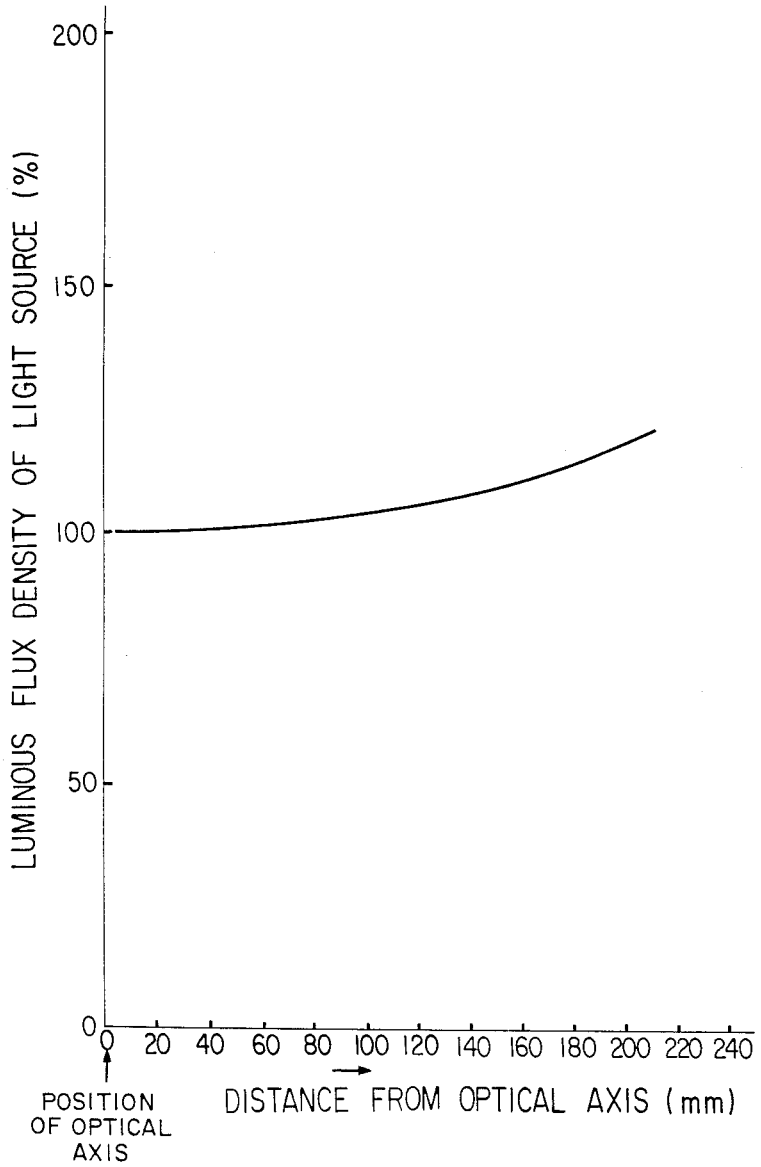
FIG. 18 is a light distribution characteristics diagram of a light source according to a preferred embodiment 2.

In addition, the form of the light source light distribution-adjusting means 72 is not limited only to one as shown in FIG. 18 but the light source light distribution-adjusting means is preferably shaped so as to easily obtain the predetermined light source light distribution.

Figure 7:
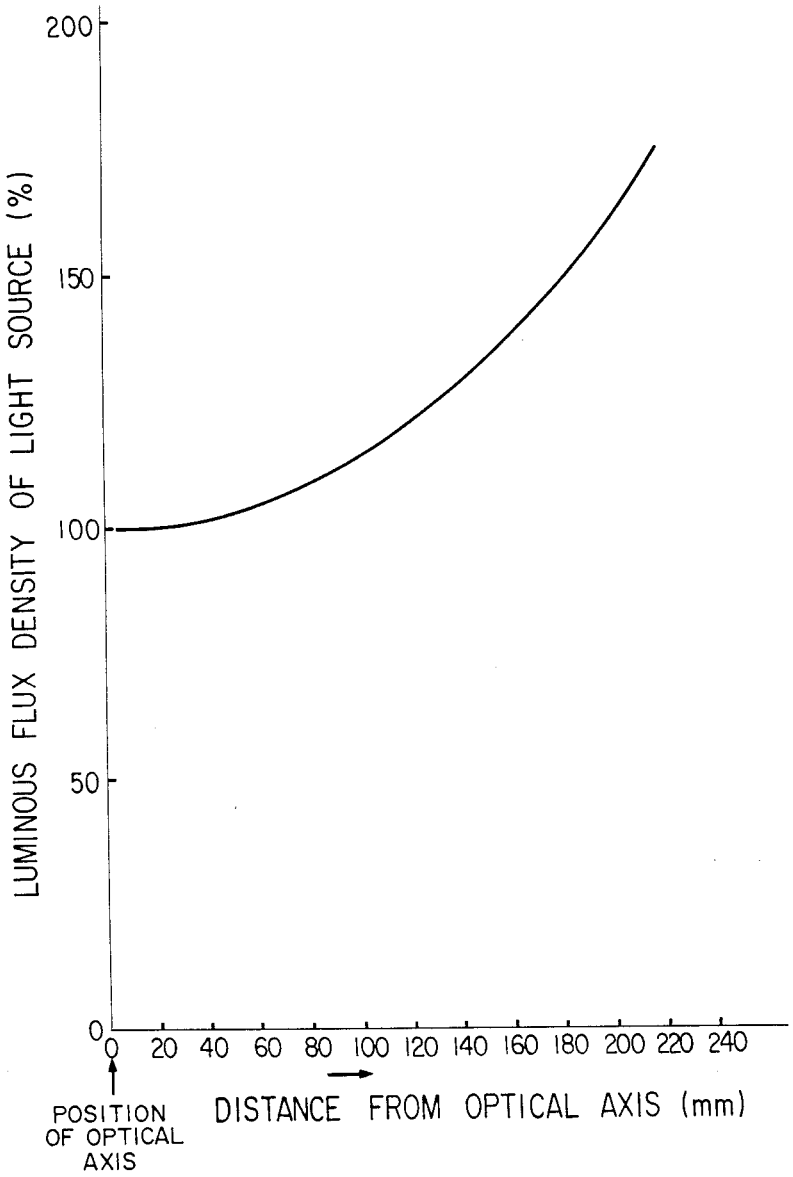
FIG. 7 is a light distribution characteristics diagram of said light source.
Figure 14:
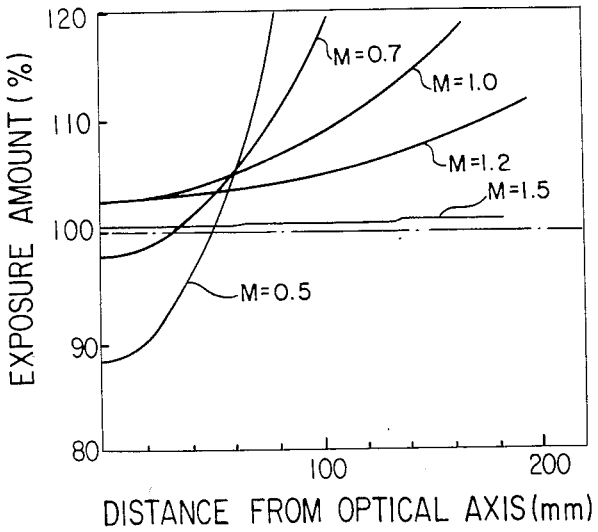
FIG. 14 is an exposure amount distribution characteristics diagram on a sensitive surface of each magnification in the case where the light distribution correction is not carried out.

The present inventor simulated the exposure distribution characteristics on the surface of the photo-sensitive member 12 without any optical cut off by changing the magnification m from 0.5 to 1.5 every 0.1 by the use of the light source 3 having the light distribution characteristics as shown in FIG. 7 that the light distribution is flattened on the photo-sensitive member 12 at the magnification m=1.55. The result is shown in FIG. 14. The exposure amount in the peripheral area is larger than that at the center at each of the magnifications.

THE CONFIGURATION OF THE OPTICAL CUT OFF PLATE

As shown in the FIG. 14, an increasing ratio of the exposure amount in the peripheral area relative to that at the center is maximum at the smallest magnification. Accordingly, it is necessary that the luminous fluxes optically cut off by the optical cut off plates 23, 24 mounted on the side of the photo-sensitive member 12 of the lens 30 are maximum in amount at this minimum magnification.

As described above, in the present preferred embodiment, the optical cut off plates 23, 24 are arranged perpendicular to the optical axis 31 and rotated in front and rear directions of the optical axis 31 to carry out an effective optical cut off by the shape projected on a surface vertical to the optical axis 31.

Accordingly, also the angle formed between the surfaces of these optical cut off plates 23, 24 and the optical axis 31 is maximum at the smallest magnification. Provided that this angle is $\alpha$, $0<\alpha\leqq 90°$ holds good. Consequently, the shape of the optical cut off plates 23, 24 is set so that the shape projected on the surface vertical to the optical axis may flatten the exposure distribution on the photo-sensitive surface at a certain magnification smaller than that, which determines the conditions of the light source, when the surface of the optical cut off plates 23, 24 is arranged at a certain angle ($\neq 0$) relative to the optical axis of the lens.

In the present preferred embodiment the angle $\alpha$ formed between the optical cut off plate and the optical axis at the smallest magnification in the variable magnification range of the copying machine is selected at a certain maximum angle within a range of $0<\alpha\leqq 90°$ making the light distribution on the sensitive surface flat.

For example, when the magnification m of 0.5 is the minimum magnification, the shape is selected so as to flatten the exposure distribution on the surface of the photo-sensitive member 12 when the optical cut off plates are arranged at the angle $\alpha$ (90°), at which the surface of the optical cut off plates is at right angles with the optical axis 31, at the minimum magnification.

Figure 10:
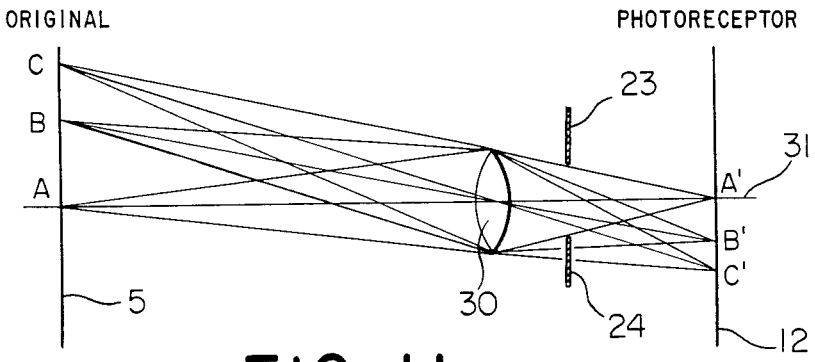
FIG. 10 is a diagram showing an optical cut off by an optical cut off plate.
Figure 11:
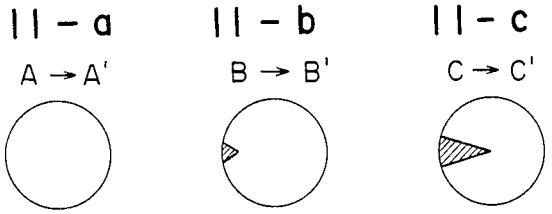
FIGS. 11 (*a*) to (*c*) is a diagram showing an optical cut off of a path of each luminous flux as shown in FIG. 10.

This shape can be easily determined by the use of a computer. That is, the area of the optical cut off plates 23, 24 occupying in the luminous flux incident at an angle of $\theta$ may be determined so that the density of the luminous flux incident at the angle of $\theta$ to the optical axis 31 may be about same as that of the luminous flux passing the optical axis. In FIG. 10, of the luminous fluxes passing the optical axis 31, the luminous flux in the course A→A′ is not optically cut off (FIG. 11 (*a*)), the luminous flux in the course B→B′ being optically cut off to some extent (obliquely lined portion in FIG. 11 (*b*)), and the luminous flux in the course C→ C′ being remarkably cut off (obliquely lined portion in FIG. 11 (*c*)). In short, the long distance protion from the optical axis shows the optical cut off to a greater extent.

Since the angle $\theta$ is changed in dependence upon the position of the lens 30, that is to say the magnification, and the position at which the flux passes through the optical cut off plates 23, 24, is changed in dependence upon the value of this angle $\theta$, while the value of $\theta$ is increased little by little beginning with $\theta=0°$ (without the optical cut off plate), the numerical value of a width of the optical cut off plate can be so determined that the exposure amount on the surface of the sensitive member 12 may be equal to that at $\theta 0=0°$.

Figure 12:
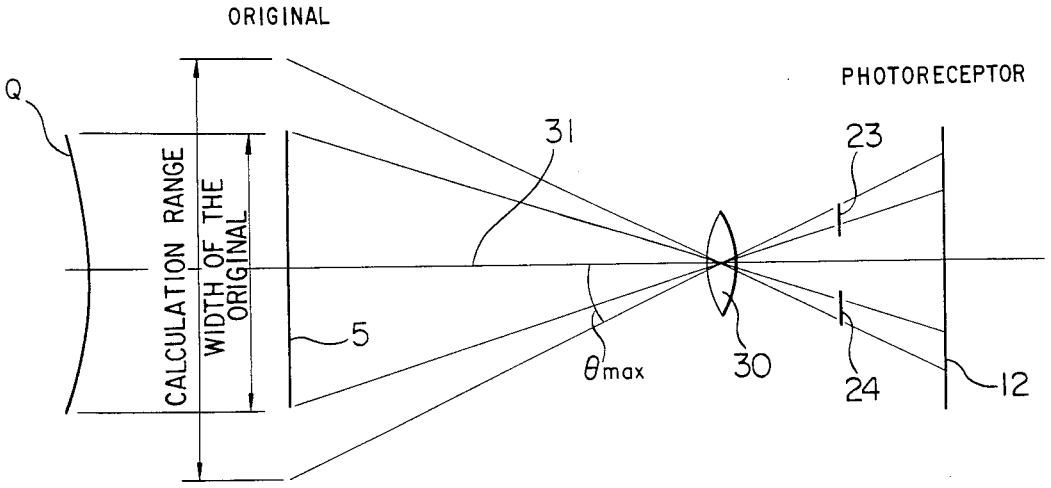
FIG. 12 is a diagram showing a calculation for determining a shape of the optical cut off plate in the preferred embodiment 1.

Now, the magnification for determining the shape of the optical cut off plates 23, 24 is minimum and the surface of the original draft 5 or the photo-sensitive member 12 is limited in size. Accordingly, the shape of the optical cut off plate determined by the above described method may be thought to show its effect within a narrow range of $\theta$ corresponding to the magnification based on the above limited size. However, in the determination of the shape the calculation may be preferred to be carried out until the value of corresponding to the maximum picture angle of the maximum magnification provided that the size of the both surface of the original draft and the photo-sensitive member are remarkably larger than that of the actual one (refer to FIG. 12). It is of course supposed that also the light distribution of the light source continues until this range.

Figure 13:
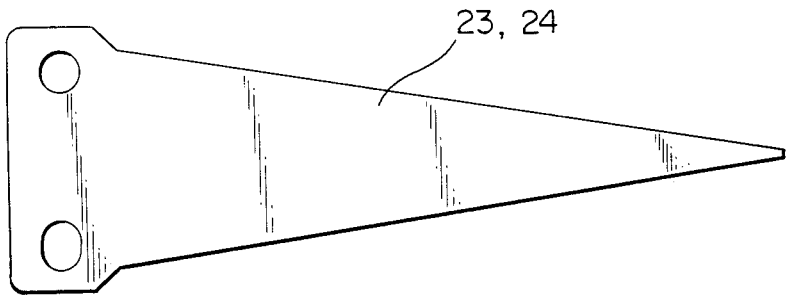
FIG. 13 is a plan view showing a shape of the optical cut off plate.
Figure 15:
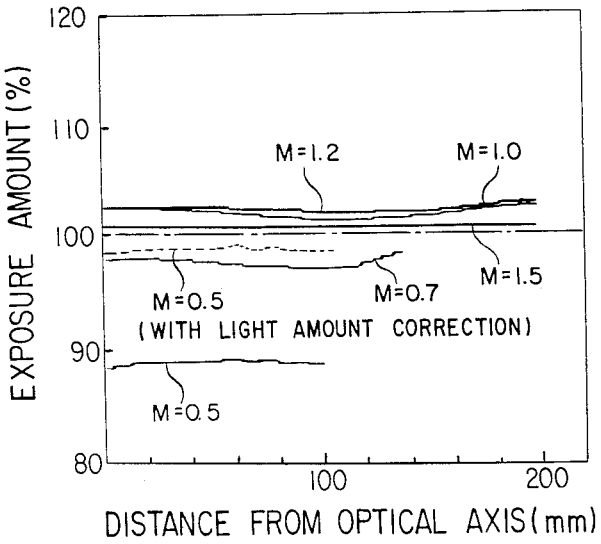
FIG. 15 is light amount distribution characteristics diagram in the case where the light distribution correction is carried out in the preferred embodiment.

FIG. 13 shows the plane shape of the optical cut off plates 23, 24 determined in the above described manner. The light distribution correction was simulated using the optical cut off plate as shown in FIG. 13 and giving the appointed angle at each magnification. The resulting exposure distribution characteristics on the photo-sensitive member 12 are shown in FIG. 15. The maximum magnification m is 1.55.

Accordingly, in the copying machine comprising the exposure light source 3 and the optical cut off plates 23, 24 if the surface of the optical cut off plates 23, 24 is arranged in parallel to the optical axis 31 of the lens to make the optical cut off amount nearly zero at the maximum magnification, the exposure distribution of the photo-sensitive member 12 becomes nearly flat while if the angle between the surface of the optical cut off plates 23, 24 and the optical axis 31 is set at the angle $\alpha$ (90° in the present preferred embodiment) at the minimum magnification, also the exposure distribution on the photo-sensitive member 12 at this magnification becomes nearly flat.

And, the nearly uniform exposure distribution can be achieved for all magnifications by suitably setting the shape of the cam surface 36*a* of the cam 36 and suitably selecting the angle $\alpha$ between the optical cut off plates 23, 24 and the optical axis 31 at each magnification between the maximum magnification and the minimum magnification, as shown in FIG. 15. In addition, this angle $\alpha$ shows the maximum optical cut off amount at the minimum magnification, the optical cut off amount being gradually decreased with an increase of the magnification, and the exposure distribution becoming nearly flat at every magnification.

In addition, in this preferred embodiment 1 in order to emphasize the theoretical strictness, the maximum value of the variable magnification range of the copying machine is made coincident with the magnification at which the exposure distribution on the photo-sensitive member becomes uniform at a certain light source light distribution without any optical cut off (without light distribution correction) while the minimum value of the variable magnification range is made coincident with the magnification at which the exposure distribution on the photo-sensitive member 12 becomes uniform at the maximum optical cut off amount by the optical cut off plates 23, 24.

And, although the uniform exposure distribution can be achieved on the photosensitive member at every magnification by suitably selecting the angle between the optical cut off plates 23, 24 and the optical axis 31 so far as the variable magnification range of the copying machine is set within the above range, in view of practical point, some allowable width exists. For example, even though the maximum magnification is selected at the magnification which is slightly larger than the magnification, at which the exposure distribution on the sensitive member 12 by the light source becomes uniform without any optical cut off, and the minimum magnification is selected at the magnification which is slightly less than the magnification at which the exposure distribution on the photosensitive member 12 becomes uniform at the maximum optical cut off amount by the optical cut off plates 23, 24, the similar effect can be achieved.

That is to say, the light distribution of the light source may be allowed to be set so that the exposure distribution on the surface of the photo-sensitive member after passing through the lens may become uniform at a certain magnification; the configuration of the optical cut off plate may be allowed to be set so that the shape projected on the surface vertical to the optical axis may make the exposure distribution on the surface of the photo-sensitive member uniform at a magnification less than said certain magnification when the surface of the optical cut off plate is arranged at a certain angle ($\neq 0$) to the optical axis of the lens; and the variable magnification range of the copying machine may be allowed to be contained nearly in this range.

And, as a result, the fluctuation of the exposure distribution may slightly take place but the influence thereof hardly appears in practical use.

Thus, the device can be remarkably simplified in construction and the sufficient light distribution correction can be achieved over a wide range of magnification. Since even though the optical path 1 is shifted up and down to some extent, as shown in FIG. 3, the optical cut off amount at each position in a longitudinal direction of the section of the optical path is hardly changed, whereby hardly having an influence by the shift of the optical path, and the optical cut off plates 23, 24 can be made exist in an almost reasonable from over an almost all range in a longitudinal direction of the section of the optical path 1, a region having a locally high light amount can be prevented from being generated. In the event that the width of the optical path 1 is reduced in the copying at reduced magnifications, such an advantage is particularly remarkable. In addition, an unnecessarily large movement of the optical cut off plate is not required. Furthermore, in the event that in particular the reducing magnification is relatively small in the copying at the reduced magnification, the angle between the plane surface of the optical cut off plate and the optical axis of the lens approaches to a right angle, whereby if the shape of the optical cut plate has a good accuracy, the area of the optical cut off plate occupying in the optical path hardly has an influence by some fluctuation of this angle. That is to say, in the event that the reducing magnification is small, a highly accurate light distribution correction can be achieved. Since in the event of the equal-size copying and the enlarged copying the optically cut off range is remarkably slight, a light from the light source is not optically cut off in vain.

Consequently, in the event that the light distribution correction is not carried out, a difference between the exposure amount in the vicinity of the optical axis and that in the circumferential exceeded 20% at the reduced magnification of 0.5, as shown in FIG. 14 while in the event that the correction was carried out, the difference of light amount in the exposure distribution was less than 1%, as shown in FIG. 15. And, also the fluctuation of whole exposure amount was through all the magnification range ($\times$0.5 to 1.55) about 10%. And, when the over all luminous flux density of the light source was increased in the copying at reduced magnifications, the fluctuation of the whole exposure amount was reduced to less than 5% through all the magnification range, as shown by a broken line in FIG. 15.

Modifications of the Preferred Embodiment 1

Figure 16:
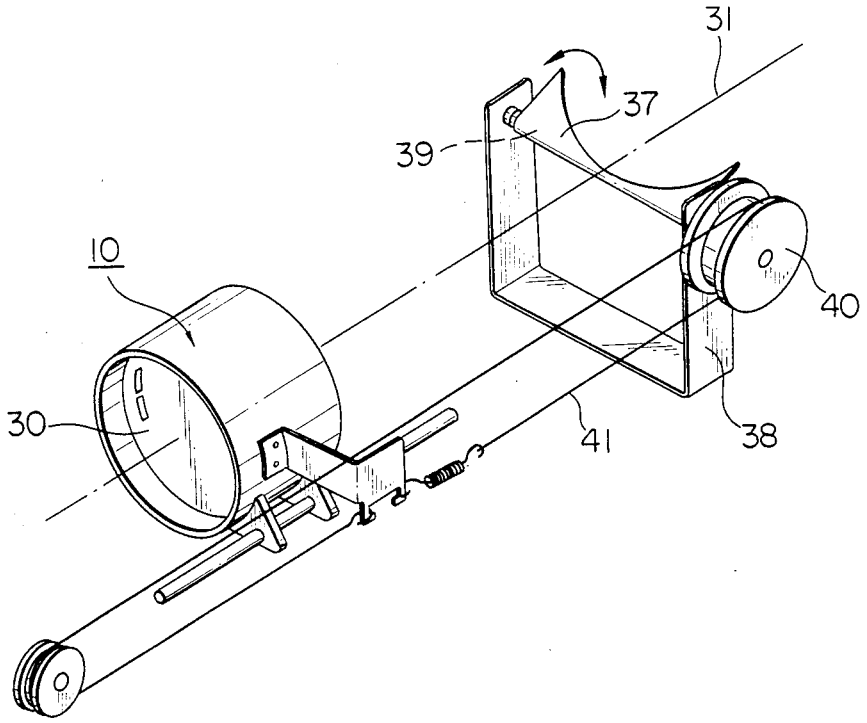
FIGS. 16, 17 are diagrams showing a modification of the light distribution correction mechanism according to the preferred embodiment 1.

As described above the optical cut off plates 23, 24 are adapted to move together with the lens 30. In this modified embodiment as shown in FIG. 16, an optical cut off plate 37 formed of one sheet is mounted on a support member 38 fixedly mounted on the copying machine and a pulley 40 is mounted on a shaft 39 of the optical cut off plate 37, and the pulley 40 is connected to a lens mechanism 10 by means of a wire 41, whereby the optical cut off plate 37 can be rotated with the movement of the lens mechanism 10 and the light distribution correction can be carried out as shown in FIG. 16.

The shaft 39 may be rotated by means of a motor to control the angle of the inclination of the optical cut off plate 37 as necessary. In addition, the optical cut off plate consists of one sheet, which does not necessitate the use of the connecting arm 33. The rotation axis of the optical cut off plate is not necessarily crossing in perpendicular with the optical axis of the lens.

Figure 17:
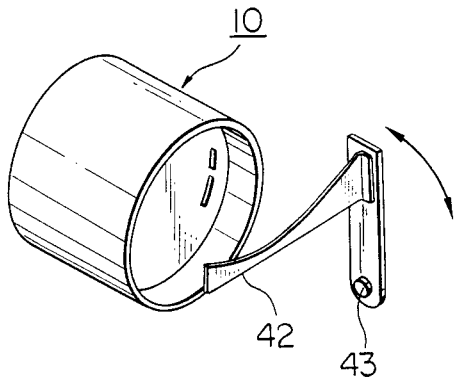

The rotation axis of 43 of the optical cut off plate 42 is not always required to be placed on the optical cut off plate 42 as shown in FIG. 17. The configuration of the optical cut off plate 42 is not necessarily symmetric. In particular, it is preferable that a copying machine of one-sided standard type is unsymmetric in the longitudinal direction thereof.

The optical cut-off plate is not always required to be placed between the lens and the photo-sensitive member. The efficiency to be obtained by the arrangement in which the optical cut-off plate is placed between the lens and the photosensitive member is similar to that to be obtained by the arrangement in which the optical cut off plate is placed between the original draft and the lens.

Preferred Embodiment 2

Another preferred embodiment of the present invention applied to a copying machine will be described below. The light distribution of the light source illuminating the original draft may be set so that the exposure distribution on the surface of the photo-sensitive member after the light source passes through the lens is uniform at a certain magnification without cutting off the light (or without using the optical cut-off plate) and the shape of the optical cut off plate may be set so that the shape projected on a surface vertical to the optical axis of the lens may make uniform the exposure distribution on the surface of the photo-sensitive member at a magnification larger than the above-described magnification when the surface of the optical cut off plate is placed at a certain angle relative ($\neq 0$) to the optical axis of the lens.

This is contrary to the above-described preferred embodiment 1. If the light source, which makes the exposure distribution on the surface of the sensitive member flat at a certain magnification without using the optical cut off plate, is used, the light amount in the peripheral area of the optical axis becomes less than that at a center of the optical axis with the increase of a magnification than the above-described magnification. In other words, the light amount at the center, of the optical axis becomes larger than that in the peripheral area. Accordingly, a relatively higher light amount at a central portion ought to be reduced with an increase of the magnification.

In this case, the configuration of the optical cut off is different from that used in the above-described embodiment 1, that is, it is wider at the central portion thereof and narrowed toward the peripheral area thereof. The optical cut off plate forms a certain angle $\alpha$, whereby the largest optical cut off amount is imparted to the optical axis at a certain magnification larger than the above-described magnification and an optical cut off amount is reduced with the reduction of magnifications.

The light distribution characteristic of the light source 3 in the preferred embodiment 2 is shown in FIG. 18. The light distribution correction mechanisms using the optical cut off plate 44 according to the preferred embodiment 2 are shown in FIGS. 19, 20. FIG. 19 shows the angle at the maximum optical cut off. FIG. 20 shows the angle at the minimum optical cut off.

Embodiment 3

Embodiment 3 will be described hereinafter. First, the light distribution of a light source is so set that "The exposure amount distribution on a photo-sensitive member obtained by a light passing through a lens is set to be uniform at a certain magnification" without using the optical cut-off plate. Then, an optical cut off means is constructed with a plurality of faces such that "When one of these faces is placed at a certain angle ($\neq 0$) relative to the optical axis of a lens, the configuration of the one of the above faces projected on the plane perpendicular to the optical axis of the lens makes uniform the light amount distribution on the photo-sensitive member when magnifications are greater than the above-described certain magnification". Further, "When the other face of the above faces is placed at an angle ($\neq 0$) different from the above-described angle, the configuration of the other face of the above faces projected on the plane perpendicular to the optical axis of the lens makes uniform the light amount distribution on the photo-sensitive member when magnifications are smaller than the above-described certain magnification".

Figure 21:
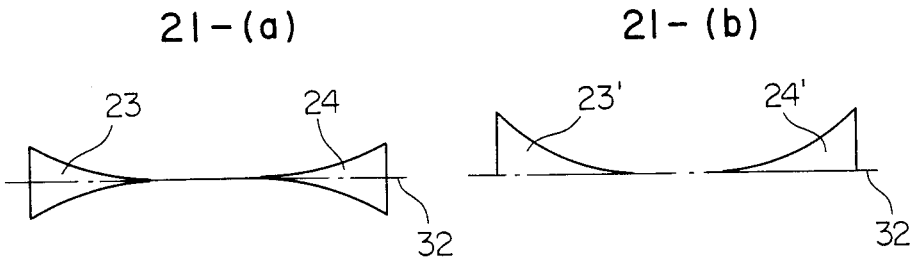
FIG. 21 and FIGS. 22 (*a*), (*b*) are diagrams showing the production of an optical cut off plate according to a preferred embodiment 3.
Figure 22:
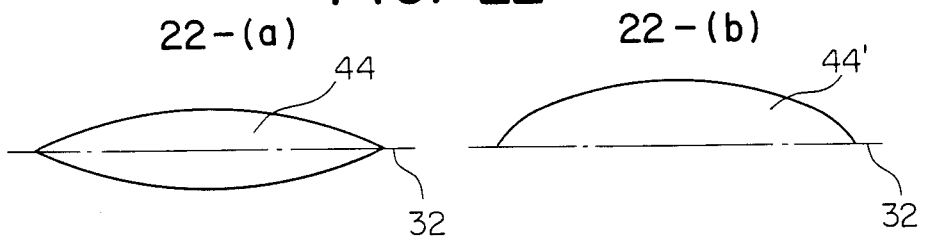

The above-described construction combines the construction of Embodiment 1 with Embodiment 2. In this embodiment, an advantage different from those described above can be obtained in the construction in which an equal magnification copying is carried out in the intermediate magnification range of all of the magnifications. This advantage can be obtained when the optical cut off plate has the following construction:

The optical cut off plates 23 and 24 according to Embodiment 1 shown in FIG. 21 (*a*) are constructed to have the configurations 23' and 24' shown in FIG. 21 (*b*), that is, the optical cut off plates 23' and 24' are positioned at one side only relative to a rotation center axis 32. An optical cut off plate 44 of Embodiment 2 shown in FIG. 22 (*a*) is also changed to have the configuration of an optical cut off plate 44', shown in FIG. 22 (*b*), which is positioned at one side only relative to the rotation center axis 32. "A certain angle" described in Embodiments 1 and 2 is the same as the angle described below. This "certain angle" is assumed to be $\alpha \leqq 90°$.

Figure 23:
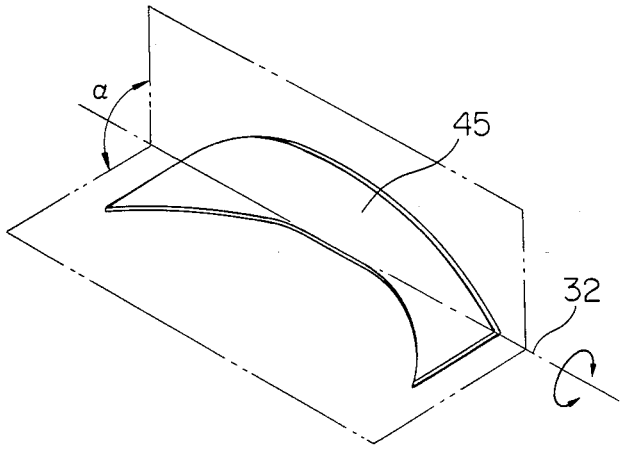
FIG. 23 is a perspective view showing the optical cut off plate according to the preferred embodiment 3.

The optical cut off plates 23', 24', and 44' shown in FIGS. 21 (*b*) and 22 (*b*) are incorporated such that the above-described three plates have the common rotation center axis as shown by symbol 32 in FIG. 23 wherein the angle formed between the plates 44' and the plates 23' as well as 24' is $\alpha$.

In this construction, as described above, the optical cut off plates act as one member which is rotatable, so that it is unnecessary to provide the connecting arm 33 according to Embodiment 1. Further, the degree of the fluctuation of the total exposure amount of all the magnification range is made smaller than those of Embodiments 1 and 2. This is because when a light is not cut off, the total exposure amount is maximum in equal magnification copying (refer to FIG. 14). When these optical cut off plates are used, the cut off light amount of the central area must be same as that of the peripheral area. In this case, the projected area of the optical cut off plate is greatest and the reduction of the total exposure amount is also greatest.

The mode of the optical cut off plate 45 when the cut off light amount in enlarging magnification copyings become greatest is shown in FIGS. 24 (*a*) and 24 (*b*). The mode of the optical cut off plate 45 in equal magnification copyings is shown in FIGS. 25 (*a*) and 25 (*b*). The mode of the optical cut plate 45 in reducing magnification copyings become greatest is shown in FIGS. 26 (*a*) and 26 (*b*).

From the foregoing description, it is apparent that according to the present invention, the device is easily constructed, and a favorable light distribution correction can be carried out in wide magnification range, that is, a change from a greatly reduced magnification copying to a greatly enlarged magnification copying can be performed, and optical cut off members can be provided in proper configurations in most of the regions in the longitudinal direction of the cross section of the light path, and further, phenomenon which a region has a high luminous density does not occur.

Next, the problem of light amount correction will be described hereafter.

Figure 27:
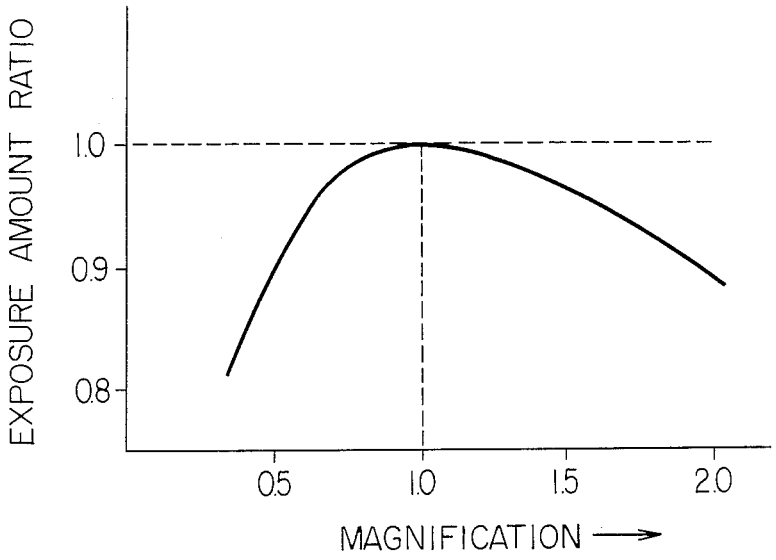
FIG. 27-*a* is a diagram showing a conventional optical cut off.

When varying the magnification while using same light source, the exposure amount on the photosensitive member may have a peak value at an equal size magnification and tends to reduce its value with both reduction and increment of the magnification, thereby obtaining the curve as shown in FIG. 27-*b*.

If assuming the magnification as being 2.0 double size enlargement) or 0.5 (half size reduction), their exposure amount will be reduced more than 10% comparing with that of the equal magnification, the influence on the copy density caused by this reduction may be not allowable.

FIG. 15 indicates the correction result in which the reduction of exposure amount at the reducing magnification ($M=0.5$) is rectified by adjusting the light source so as to increase total luminous flux density thereof.

An image-forming device, according to the present invention, will be described. In the device, the fluctuation of the above-described exposure amount is corrected not by adjusting the total luminous flux density of a light source but by using the light amount-adjusting plate according to the present invention.

Embodiment 4

Figure 31:
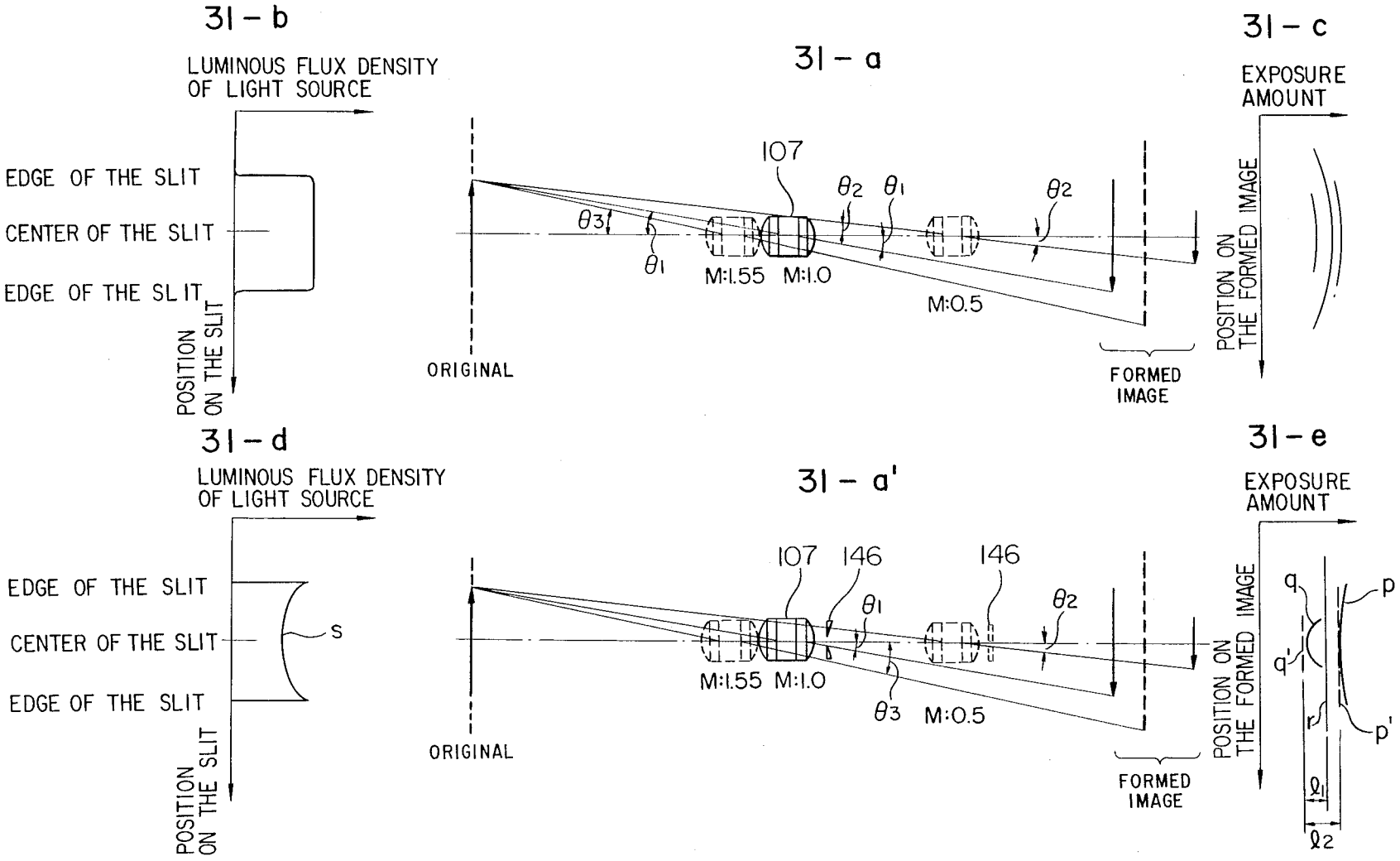
FIG. 31 (*a*) is a diagram showing a change of an incident angle $\theta$ upon the lens with a variation of magnification.

FIG. 31 (*a*) shows an original draft, the positions of lenses in each magnification copying, and image-formed positions. FIG. 31 (*b*) shows the luminous flux density of a light source by corresponding it to the position on the slit. FIG. 31 (*c*) shows the exposure amount corresponding to the position on the formed-image and the exposure amount distribution when a light distribution correction is not carried out.

In this case, the exposure amount distribution is not uniform even in the same magnification in accordance with the "$\cos^4\theta$ law" because a light distribution correction is not carried out.

In the light distribution correction device described above, the rotatable light distribution adjusting member 146 (members having the same function as those of the optical cut off plates 23 and 24 are referred to as light distribution adjusting members) is provided in the rear of a projection lens in order to adjust the condition of the cut-light on the light path by changing the rotation angle depending on the change of a projection magnification whereby the light distribution in each magnification is made uniform.

In the optical system as shown in FIG. 31 (*a'*), when the luminous flux density, namely, the light distribution after a light reflected from the original draft passes through the slit is set as shown by S in FIG. 31 (*d*) and magnification is 1.55, the exposure amount distribution of the image-formed face is uniform as shown by the line r in FIG. 31 (*e*). At this time, the rotation position of the light distribution adjusting member does not cut off light. When magnification M is changed, i.e., when M is reduced to, for example, 0.5, the exposure amount distribution is as shown by q in FIG. 31 (*e*) when the light distribution adjusting member is not operated. This exposure amount distribution is corrected so that it becomes q' by rotating the light distribution adjusting-member by an appropriate angle. Likewise, when M is 1.00, namely, nearly equal magnification, the exposure amount distribution is shown by p when the light distribution adjusting-member is not operated. This exposure amount distribution is avoided by rotating the light distribution adjusting member at an appropriate angle so that the exposure amount distribution may become p' which is a uniform exposure amount. Nevertheless, as shown in FIG. 31 (*e*), there is differences in exposure amount 12 between p' and q' and $l_2$–$l_1$ between p' and r. It may be possible to correct these differences by changing the voltage of a light source lamp. The use of light source lamps such as a halogen lamp by changing a rated voltage to a great extent, however, does not make the best use of a halogen lamp and reduces its lifetime.

The present invention has solved such a problem by providing a correction mechanism having a simple construction, i.e., the mechanism is capable of favorably correcting light distribution and light amount whereby the difference in exposure amount is eliminated in carrying out copies of various projection magnifications. Further, in this correction operation, the characteristics of a light source lamp is not lost.

More specifically, the correction mechanism according to the present invention comprises a light path regulating means having a slit which regulates a light reflected from or passed through an original draft and a lens which forms the image of the original draft wherein light distribution and light amount can be corrected by providing a rotatable light distribution adjusting member and a light amount adjusting member in an inner side of the longitudinal direction of the cross section of a light path whose cross section is regulated to be a rectangular shape or similar to that by the light path regulating member.

FIG. 29 is a schematic diagram illustrating a related area of image forming system having incorporated a correction mechanism, for light distribution and light amount, in an image projection mechanism according to the invention.

In this drawing, an image of original draft positioned on a draft deck 180 is irradiated with a lamp 102 on a first traveling deck, and the reflected light is transmitted via a slit 103, a mirror 104, and mirrors 105 and 106 on a second traveling deck running at a speed half that of the first traveling deck A, then a projection lens 107, a light distribution controlling means 146, a light amount controlling means 148 and a mirror 108 to the surface of a photosensitive drum 109, where an image is formed.

With an image projection mechanism in such an image forming member, a magnification M of a projected image in relation to an original draft is variable. Accordingly, the position of the projection lens 107 as well as the positions of mirrors 105 and 106 are set in correspondence to each magnification.

When M=1, the initial scanning position of mirrors 105 and 106, as well as the fixed position of lens 107 are as shown by the solid line in FIG. 29.

A magnification M can be designated almost steplessly. For convenience, in addition to M=1, an enlarging magnification is typified by M=1.55, and a reducing magnification by M=0.5. The positions of lens 107, mirrors 107 and 106 at M=1.55 and M=0.5 are respectively shown by broken lines in FIG. 29. The distance from an original position to the mirrors 105 and 106, or the traveling deck B, is 58.75 mm if a magnification is varied from M=1 to M=0.5; 22.93 mm if a magnification is varied from M=1 to M=1.55. The variation in fixed position of the projection lens 107 is 117.5 mm if a magnification is varied from M=1 to M=0.5; 129.25 mm if a magnification is varied from M=1 to M=1.55.

The following describes a mechanism in relation to the shifting of the first and second traveling decks, and a method to change the starting position of second traveling deck and the setting position of projection lens in accordance with a modified magnification.

Figure 28:
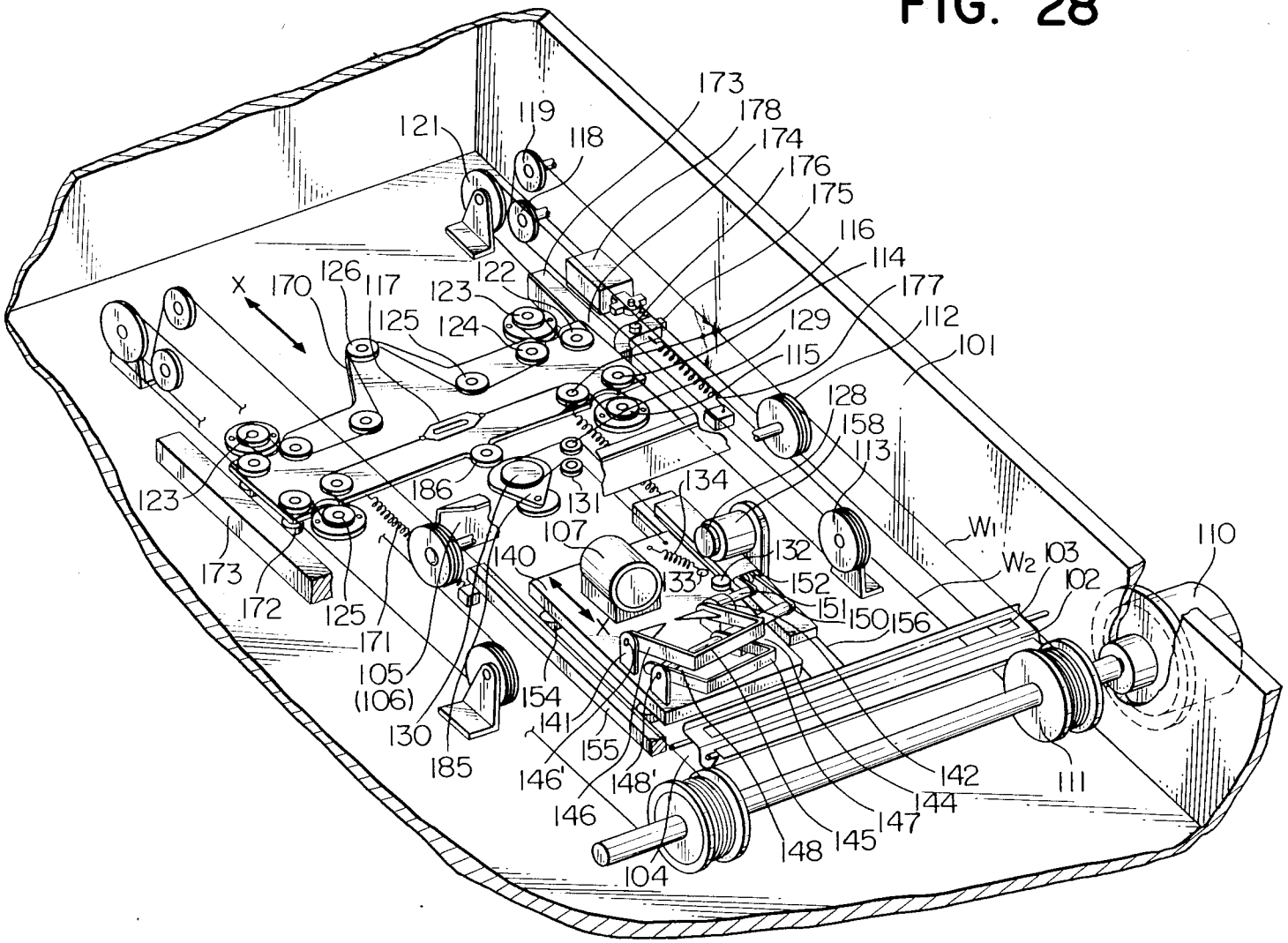
FIG. 28 is a perspective view showing an image projection mechanism with one preferred embodiment according to the present invention incorporated.

With FIG. 28, to drive the scanning system, a wire is wound around a pulley 111 connected to the shaft of motor 110 (maybe connected via an unshown clutch brake). The front half W1 of the wire is wound around a pulley 112, further guided via pulleys 113, 114, 115 and 116, and secured to a movable pulley-deck 170 with retainer 117. The above-mentioned pulleys 114 and 116 are provided on the movable pulley-deck 170. Other pulleys with the exception of the pulley 112 mounted on the second traveling deck are those rotating on the shafts fixed on a main body 102.

The rear half W2 of wire wound around the pulley 111 is guided via pulleys 118 and 119 and wound around the above-mentioned pulley 112 in a direction reverse to that for W1, further guided via pulleys 121, 122, 123, 124 and 125, wound around a pulley 126 on the movable pulley-holder 170 (though not shown, the pulley exerts a tension of the wire), and led to a wire being symmetrical to it, as mentioned later. Thus the wire constitutes a closed loop. The pulleys 122, 124, 125 and 126 are provided on the movable pulley-deck 170.

Additionally, pulleys independently in a symmetrical position to a corresponding pulley, as shown in FIG. 28, are provided. A like wire W1 and W2 similarly runs along the pulleys and supported at its both ends by pulleys. The two wires are supported by pulleys so that they can be driven coordinately.

The first traveling deck having incorporated a lamp 102, slit 103 and a mirror 104 is secured to the wire W1. The pulley 112 is rotatably attached to a shaft provided on the second traveling deck B comprising V mirrors 105 and 106. Though un-shown in the drawing, the first and second traveling decks can independently move by the guidance of rails disposed in the running direction (shown by an arrow X) of independent deck. The movable pulley-deck 170 can also move in the arrow X direction by the guidance of, for example, rails on both sides, as shown in FIG. 28.

At the same time, a lens-moving deck 140 can also move in the arrow X direction by the guidance of a roller 154 provided on it and being engaged with the rails 155 and 156.

Additionally, a pulley 133 is provided on the lens-moving deck 140. The wire whose one end being fixed on the deck via a spring 134 is wound around a pulley 128 driven by a motor 158, and, via a pulley 129, engaged to a pulley 130 mounted on the shaft of cam 129 as well as to a pulley 131, and the other end of wire is again secured on the lens-moving deck 140.

Every resetting of a magnification M actuates a stepping motor 158 mounted on the main body 101, turning the pulley 128 directly connected to the motor 158. This in turn shifts the lens-moving deck 140, which is connected to the both ends of wire wound around the above-mentioned pulley 128, to the X direction up to s specified position. At the same time, the drive of wire turns the pulley 130, turning a cam 185 which is an integral part of the pulley 130 to a specific position. This allows a cam follower 186 in contact with the above-mentioned cam 185 to shifts the movable pulley-deck 170 in the X direction up to a specified position, which further sets the initial position in the X direction of the second traveling deck, or the positions of mirrors 105 and 106. The contact between the cam 185 and the cam follower 186 is provided by the pressing force of a spring stretching across the main body 101 and the movable pulley-deck 170. While a magnification M is being changed, the motor 110 itself or a clutch brake mounted on the motor 110 is set insert, and accordingly, the pulley 111 is motionless. This means the first traveling deck is also motionless. Any change in magnification M does not cause the first traveling deck to change its position during the change in magnification. The deck always stands by at a specific starting position.

In this way, when the lens-moving deck 140 is set at a position in accordance with a designated magnification M, the position of movable pulley-deck is also set, which determines a position of the second traveling deck, or positions of the mirrors 105 and 106. Simultaneously, the light distribution adjustment as well as the light amount adjustment are effected, as mentioned later, completing a preparation in compliance with each magnification.

The pulleys 114, 116, 122 and 124 on the movable pulley-deck 170 are actuated correspondingly in relation to the pulleys 115, 113, 123 and 121 via the wires W1 and W2. For example, the wire W1 moves a length d respectively between the pulley 113 and the pulley 114, between the pulley 114 and the pulley 115, nd between the pulley 115 and the pulley 116. This means the total traveling distance of wire W1 is 3*d*. Accordingly, traveling distances of wires W1 and W2 corresponding to the movement d in the X direction of pulley-deck in relation to the pulleys 113, 121 and 112 are, respectively, 3*d*. For example, the variation of setting positions of mirrors 105 and 106, in accordance with the variation of magnification M, $M=0.5-1.55$, as mentioned before, is 58.75 mm at the maximum. The traveling distances of W1 and W2 corresponding to the maximum value, above, is $58.75\times2=117.5$ mm at the maximum. This means the traveling distance of movable pulley-deck is as small as $117.5\div3=39.16$ mm at the maximum. Such a short stroke provides the cam 185 with a smooth movement with less loads. By such an arrangement to incorporate the above-mentioned pulley-deck 170, as well as the pulleys 115 and 123 being secured on the main body at the intermediary positions in relation to the wires, not only the traveling distance of pulley-deck 170 caused by the change of magnification but the stroke of cam 185 have been reduced perspectively from 117.5 mm to $\frac{1}{3}$ or 39.16 mm. This greatly saves the space, helpting realize a small sized image forming system.

As can be understood from the description, above, once the positions of the projection lens, pulley-deck, and mirrors 105 and 106 are set in accordance with an arbitrarily designated magnification, and when the scanning is initiated, even a weak pulling force exerted on the wire is tripled on the pulley-deck. Additionally, as high-speed scanning is carried out especially with an image-forming device of the invention, some area of the movable pulley-deck receives a strong pulling force of the wires W1 and W2, and another area in contrast receives disproportionally small force. Accordingly, the pulley-deck may vibrate during traveling or may come out of alignment. This in turns may cause the first traveling deck A having the light-source lamp for exposure as well as the mirror 4, and the second traveling deck B having the mirrors 105 and 106 to vibrate, or the both decks to lose their correct positional relation, resulting in the deformation, scattering, blurring or the like of a formed image.

In view of this problem, a brake must be applied in order to ensure the movable pulley-deck 170 is motionless during scanning. Accordingly, to one side of the pulley-deck 170 is disposed a friction area 174. By pressing a friction means 175 rotatable on a fulcrum 176 against the friction area, the movable pulley-deck 170 is locked motionless.

In this way, a stable image can be obtained even from high-speed scanning.

At the same time, while a magnification is varied, the rotation of cam 185 caused by the shifting of lens-moving deck 140 exerts force via the cam follower 186 in contact with the cam 185 upon the movable pulley-deck 170, and the deck 170 is shifted. During this course, if the brake is still applied, the pulley-deck fails to shift. Accordingly, a solenoid 178 is exerted on a brake member 175 to override the force of spring 177, thus unlocking the brake.

In this preferred embodiment, a brake is provided in one side, as shown in FIG. 28. Naturally, brakes may be symmetrically provided on the both sides.

Though a brake is used in this embodiment, the similar effect can be attained by providing holes for pin, respectively corresponding to each magnification, on the side or bottom of the movable pulley-deck 170, and by engaging a pin into a hole corresponding to a magnification, in order to lock the pulley-deck 170, once the shifting to accommodate the change of magnification is completed. However, it is more convenient to use a brake to cope with the nearstepless designation of magnification.

On the lens-moving deck 140, as indicated by FIG. 28 as well as FIGS. 30 (*a*), 30 (*b*) and 30 (*c*), to the rear of the projection lens 107*b* are disposed the light distribution controlling means 146 rotatable on the shaft 146', as well as the light amount adjusting means 148 rotatable on the shaft 148'.

The light distribution controlling means 146 is shifted together with the projection lens 107 to a specified position corresponding to a magnification M by the lens-moving deck 140. During this course, a frame 145 where the light distribution controlling means 146 being attached is supported by bearings 141 and 142 at its shaft 146', and the cam follower 152 of the tip of lever 151 attached to the end of shaft 146' shifts on a rail cam 157 secured on the frame 101 of the main body, rotating the above-mentioned lever 151. Accordingly, as indicated by FIGS. 30 (*a*), 30 (*b*) and 30 (*c*), sequentially changing the position, in terms of angle, of the light distribution controlling member 146 in accordance with a magnification can realize the distributions q' and p' where the exposure amount distribution are respectively flat, as indicated by the broken line in FIG. 31 (*e*). More specifically, a distribution q' is for M=0.5, and a distribution p' for M=1.0.

In order to eliminate the differences in exposure amount, l1 and l2−l1, in relation to the exposure distribution r in the time of M=1.55, the frame 147 being fitted with the light amount controlling means 148 rotates on its shaft 148' engaged in the bearings 143 and 144 in accordance with a magnification M. The cam follower 152 of the lever 150 provided on the end of the shaft 152 is guided on the rail cam 157 secured on the main body, varying the position in terms of angle of the light amount controlling means 148, as shown in FIGS. 30 (*a*), 30 (*b*) and 30 (*c*). This eliminates the difference in exposure amount between p' and r, and q' and r, shown in FIG. 31 (*e*).

This arrangement is described more specifically, below.

An arrow respectively in the left of FIGS. 30 (*a*), 30 (*b*) and 30 (*c*) indicates a maximum draft size (approx. 300 mm for A4-sized or A3-sized paper) on the original-draft deck as one example, that is, the size of slit screen during the scanning on original draft. An arrow in the right indicates the size of slit image being formed. FIG. 30 (*a*) illustrates a magnifying operation where M=1.55. FIG. 30 (*b*) illustrates an equal-magnification operation where M=1. FIG. 30 (*c*) illustrates a reducing operation where M=0.5. The projection lens 107, the light distribution controlling means 146 and the light amount controlling means 148, being in concert with each other, change positions in compliance with a magnification. Correspondingly, the second traveling deck, unshown in the drawing, changes its position, and the length of light path as a whole varies in accordance with a magnification as shown in FIGS. 30 (*a*), 30 (*b*) and 30 (*c*).

When the slit screen having the light flux density distribution of a light source as shown by the curved line S in FIG. 31 (*d*) is used, and if the angle between the optical axis of lens and the incident light is $\theta$, the $\cos^4\theta$ law is applicable. Accordingly, when M=1.55, or the maximum magnification, the flat exposure distribution of image indicated by r in FIG. 31 (*e*) is achieved.

Correspondingly, in the case of maximum magnification where M=1.55, the light distribution controlling means 146 rotates on the shaft 146' to takes the position parallel to the optical axis of lens, as shown in FIG. 30 (*a*), and, therefore, does not function to control the light distribution. In order to decrease the exposure amount a little, the light amount controlling means 148 is rotated on the shaft 148' to the position which forms an adequate angle to the optical axis of lens.

When M=1, the exposure amount as a whole is the largest. Accordingly, the light amount controlling means 148 is positioned so that it is vertical to the optical axis of lens. In this case, the circumferential light flux density increases slightly, therefore, the light distribution controlling means 146 is positioned slightly skew to the optical axis.

In the case of minimum magnification M=0.5, by the rotation of shaft 146', the light distribution controlling means 146 becomes vertical to the optical axis of lens, as shown in FIG. 30 (*c*) and maximumly cuts off the ends of slit light in order to realize the flat distribution of light flux density, as shown in FIG. 31 (*e*). Also in this case, the exposure amount as a whole is the smallest. Therefore, the light amount controlling means 148 is positioned parallel to the optical axis of lens in order to avoid loss of exposure amount.

Due to such an arrangement, the differences, l1, and l2−l1, in exposure amount at each magnification are set to 0.

Figure 32:
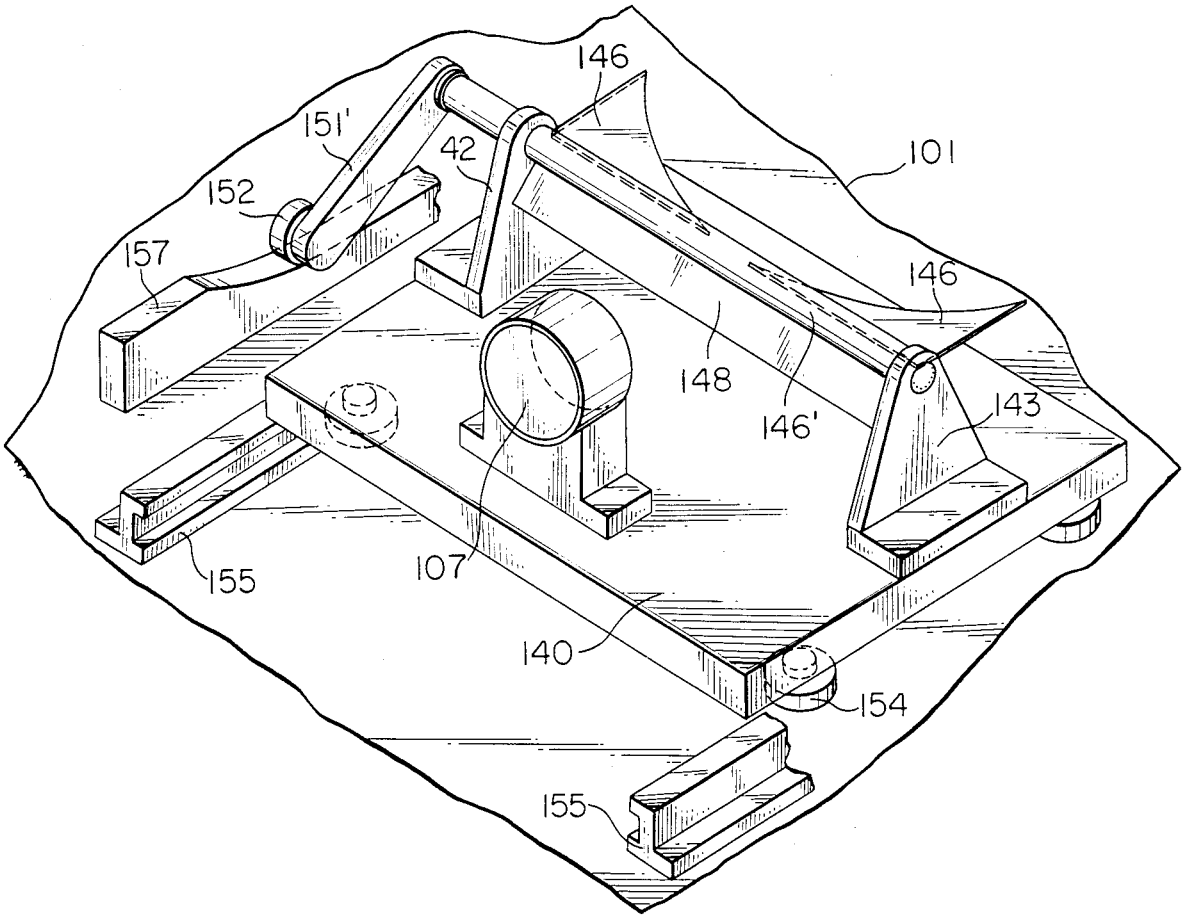
FIG. 32 is a perspective view showing another preferred embodiment of the present invention.

With the above-mentioned preferred embodiment, the shaft of light distribution controlling means and the shaft of light amount controlling means are independently provided. However, in another preferred embodiment, as shown in FIG. 32, one shaft may serve as the shaft for both means.

More specifically, a light distribution controlling means 146 and a light amount controlling means 148 are mounted on a common shaft 146', so as to form a proper angle from each other. The shaft 146' is rotatably engaged into bearings 142 and 143. On one end of the shaft 146' is fixed a lever 151', and on the tip of lever 151' is provided a roller 152 to serve as a cam follower. When the roller 152 is guided on a rail cam 157 secured on a frame 101 of main body, proper angles of rotation at a position corresponding to each magnification M is determined for the light distribution controlling means 146 and the light amount controlling means 148.

Additionally, such an arrangement provides uniform exposure distribution sufficient for practical use, for each of magnifications M being 1, 0.5 and 1.55, which are substantially the same as in the line drawing of FIG. 31 (*e*). Furthermore, the arrangement minimizes the difference in exposure amount corresponding to the difference in magnification to the degree which does not cause disadvantages in practical use.

According to the present invention, the exposure amount of the imagewise exposure can be made constant and the light distribution for each magnification can be made even by employing a simple-structure light distribution controlling means and a light amount controlling means without changing the voltage of the light source lam; therefore, life time of the light source lamp is not deteriorated, and when the color image is to be obtained the color temperature change is eliminated; thus allowing a quality image with appropriate density.

In the above-described embodiments, some examples employing optical cut off plates as both a light distribution controlling means and light amount controlling means according to the present invention are shown; however, the means for the light distribution controlling means and light amount controlling means can only satisfy the purpose of the present invention, and is not limited only to the optical cut off plate.

The embodiment described below employs an optical path regulating means as a light distribution controlling means.

Embodiment 5

In FIG. 28, the light distribution controlling means 146 (optical cut off plate) is rotatably supported through the frame 145 by the bearings 141 and 142 at the rear portion of the lens 107 on the lens moving base 140; however, instead of this optical cut off plate, the light path regulating means 246 shown in FIG. 33 may be rotatably mounted on the bearings 141 and 142 by means of the shaft 246, thus achieving the purpose of the present invention as well.

The mechanism operation, shown in FIG. 28, in the case of employing the light path regulating means 246 is same as that described in the embodiment 4.

The configuration of the light path regulating means 246 is, as shown in the perspective view 33 (*a*), comprised of two L-shaped faces formed by faces 201, 202 and 203 in symmetrically to the shaft 246'; the face 201 has the window 204 with length 1, and the face 202 and 203 have the windows 205 and 206 having a curve which gradually spread outward from the boundary ridge lines 208 and 209 of each face toward the center portion of each edge of 202 and 203; the windows 205 and 206 are connected to the above-mentioned window 204.

Figure 34:
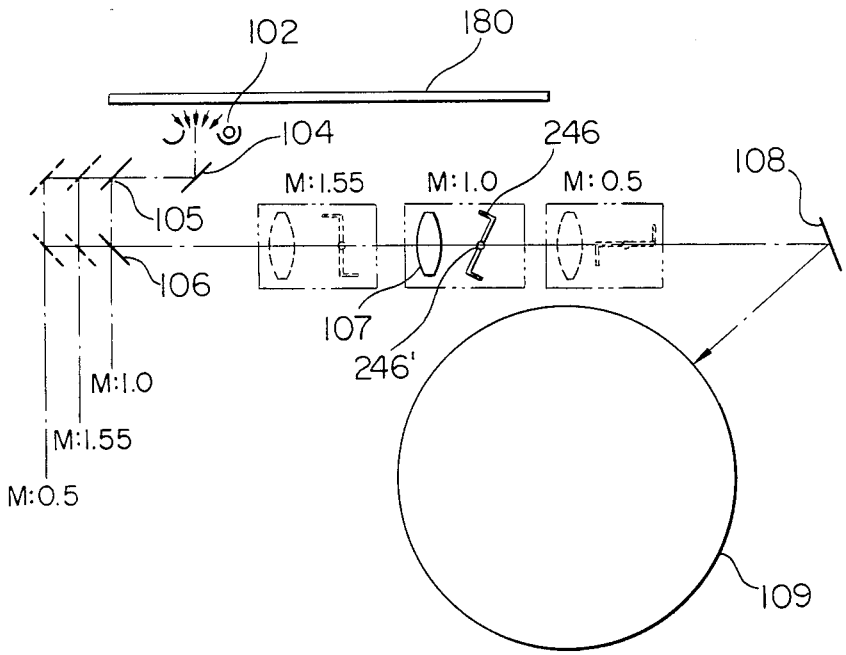
FIG. 34 is a schematic diagram showing a position of the second optical path regulating means at the enlarged, the equal-size and the reduced magnification copyings, respectively, in the image projection mechanism in which one preferred embodiment of the present invention is incorporated.

The light path regulation means 246, as shown in FIG. 34, rotates around the shaft 246'; and at the time of the maximum magnification, for example when $M=1.55$, forms a rectangular light flux regulating window, as shown in FIG. 33 (*b*), which faces the paper surface at the right angle and forms a rectangle toward the optical axis; and at the time of the same magnification, i.e., $M=1.0$, as shown in FIG. 33 (*c*), the light path regulation means 246 forms an optical flux regulating window whose center portion spreads slightly toward the optical axis which is at the right angle against the paper surface; and at the time of the minimum magnification, for example $M=0.5$, as shown in FIG. 33 (*d*), the light path regulating means 246 forms an optical flux regulating window whose center portion is particularly large.

In such a configuration described above, the relationships between the light distribution curve S of the light source, for example, shown in FIG. 31 (*d*) and the light flux regulating window of the second light path regulating means are as follows:

(1) The light distribution S of the light source has the characteristics wherein the exposure amount distribution on the photo-sensitive member becomes even, as shown by "r" in FIG. 31 (*e*), when the light flux regulation becomes rectangular at the time of the maximum magnification, as shown in FIG. 33 (*b*), i.e., the light flux distribution is virtually not regulated.

(2) The exposure amount distribution on the photo-sensitive member becomes even, as shown by the dotted line "q" in FIG. 31 (*e*), when the second light path regulating means regulates the light path in such a manner shown in FIG. 33 (*d*) at the time of the minimum magnification.

(3) The angle formed by the light path regulating means against the optical axis of the lens is made so as to make the light path regulation of the edge portion maximum at the time of the minimum magnification; and the light path regulation of the edge portion decreases as the magnification becomes larger.

The light distribution S of the light source in the case of (1) described above should not be necessarily obtained at the time of the maximum magnification; if the maximum magnification is, for example 1.55, the light distribution S may be obtained by the magnification 1.3 to 1.4, causing no practical problems.

The configuration of the light path regulating means in the case of (2) should not be necessarily the configuration whereby the exposure amount distribution becomes even at the time of the minimum magnification; therefore, for example, when the minimum magnification is 0.5, the evenness of the exposure amount distribution may be obtained at the magnification 0.6 to 0.7, causing no practical problems.

As for the angle formed by the light path regulating means and optical axis of the lens, it is important that the maximum light path regulation of the edge portion is performed around the time of the minimum magnification; the light path regulation is required to some extent up to near the same magnification; however, at the enlarging magnification side, since the lamp light distribution S exerts its effect much more effectively, if the light path regulation by means of the second light path regulating means 46 is not performed, no serious problems do not occur.

As shown in embodiment 5, the configuration of the optical cut off plates performing the light distribution correction in accordance with the respective light distribution characteristics of the light source as indicated in the embodiments 1, 2 and 3 can be applied to the light path regulating means, thereby it may be possible to carry out the light distribution correction by the same manner with the embodiments 1, 2 and 3.

Incidentally, as stated in the embodiment 4, in the event of changing the projection magnification, there is further the problem of the exposure amount correction in addition to the light distribution correction. Accordingly, another embodiment using the light path regulating means incorporated the concept of the device for performing both the light distribution correction and the exposure amount correction as indicated in the embodiment 4 according to the invention will be described hereafter.

Embodiment 6

Figure 36:
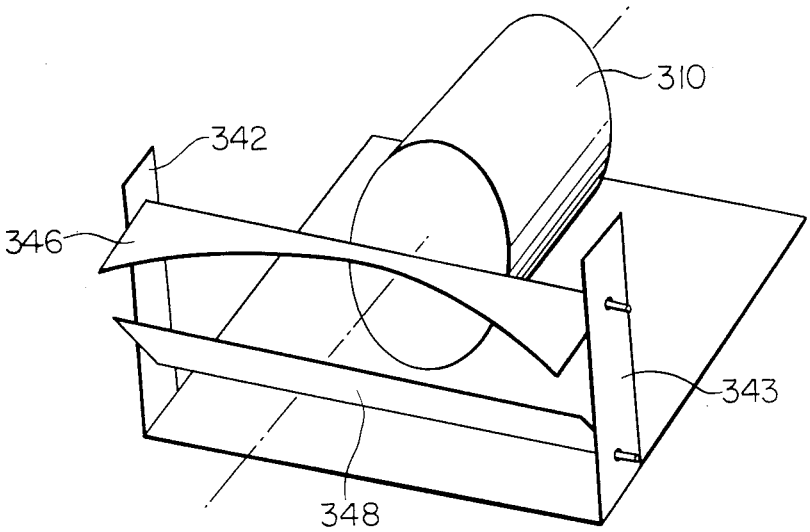
FIG. 36 is a perspective view showing another example of a second optical path regulating means consisting of a light distribution correction member and a exposure amount correction member.

FIG. 36 shows one embodiment of using the light path regulating means for performing both the light distribution correction and the exposure amount correction according to the invention.

The light path regulating means comprises a first path regulating member 346 for correcting the light distribution and a second path regulating member 348 for correcting the exposure amount, these first and second path regulating members may be incorporated in the image forming apparatus as shown in FIG. 28 in the embodiment 4 and may be operated respectively so as to rotate in same manner with the correcting procedure as indicated in FIG. 30, thereby it may be possible to carry out the both correction in same manner with the embodiment 4.

Figure 35:
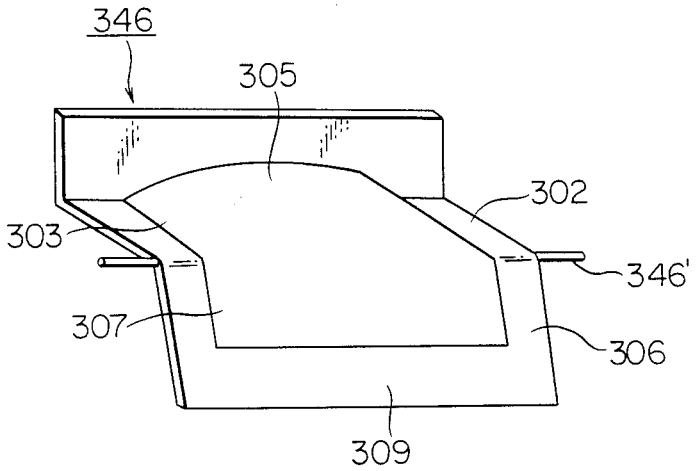
FIG. 35 is a perspective view showing another example of a second optical path regulating means.

In FIG. 35, an optical path regulating member 302 having optical path regulating figures 303 and 305 for performing the light distribution correction and another optical path regulating member 306 having optical path regulating FIGS. 307 and 309 for performing the exposure amount correction are integrated into one body via a shaft 346', respectively setting with predetermined angles. By arranging these members 302 and 306 as shown in FIG. 32, it may be also possible to carry out the both correction in same manner with the embodiment 4.

In the event of comparing the embodiment 4, in which the optical cut off plate rotates in the region within the optical path, with the embodiment 6, in which the optical path regulating member moves around the outer periphery of the optical path, as the cross-sectional plane of the optical path inevitably change its dimension in both the lengthwise direction and the widthwise direction in accordance with the variation of the magnification, the embodiment 4 using the optical cut off plate capable of performing both correction without being influenced by the change of the path dimensions may be preferred than the embodiment 6.

What is claimed is:

1. An image projecting device comprising:

an optical path regulating means having a slit introducing an image light therethrough, so that the image light has an optical path of which a sectional plane corresponds with a shape of the slit;

a projecting means having a lens for projecting the introduced image light;

an image forming plane for forming an optical image corresponding to the projected image light;

wherein there is further provided a light distribution correction means comprising an optical cut off plate for cutting off luminous fluxes of the image light, said optical cut off plate is located within the optical path of the image light and has a curved side shaped so as to make the light distribution on said image projection plate to be flat;

an image-irradiating means for scanning an original image with a light source having a light distribution in a lenghtwise direction of the slit wherein the dimension of said optical cut off plate is determined in accordance with the light distribution of said light source;

wherein said projecting means can change a projecting magnification of the optical image in accordance with a magnification input; and wherein said optical cut off plate is turned within the optical path in accordance with the inputted magnification.

2. A light projection apparatus for projecting light emanating from a light source onto an image plane, the apparatus comprising:

beam forming means disposed between said light source and said image plane for forming a beam of light from light emanating from said light source, said beam of light having a longitudinal extent and a lateral extent;

projection means, having an optical axis, for projecting said beam of light along said optical axis and for forming an image of said beam of light on said image plane, said projection means being movable along said optical axis to change its magnification power; and light distribution correction means for changing the distribution of light in said beam of light along said longitudinal extent in proportion to the change of the magnification power of said projection means.

3. An apparatus as claimed in claim 2, wherein said light distribution correction means establishes a uniform longitudinal distribution of light in said beam of light for all powers of magnification of said projection means.

4. An apparatus as claimed in claim 2, further including light attenuation means for uniformly attenuating the intensity of light in said beam of light in proportion to the magnification power of the projection means, said light attentuation means maintaining a constant level of light intensity on said image plane for all magnification powers of the projection means.

5. An apparatus as claimed in claim 2, wherein said light distribution correction means includes one or more optical cut off plates rotatable about an axis of rotation, said axis of rotation being substantially perpendicular to said optical axis.

6. An apparatus as claimed in claim 5 wherein said one or more co-planar optical cut off plates have a linear extent perpendicular to said axis of rotation that varies along the axis of rotation from the optical axis.

7. An apparatus as claimed in claim 6 wherein said linear extent increases continuously along the axis of rotation from the optical axis.

8. An apparatus as claimed in claim 7 wherein said one or more cut off plates are rotated from a minimum cut-off position wherein said one or more cut off plates are substantially parallel to said optical axis as the magnification of the projection means decreases.

9. An apparatus as claimed in claim 6 wherein said linear extent decreases continuously along the axis of rotation from the optical axis.

10. An apparatus as claimed in claim 9 wherein said one or more cut off plates are rotated from a minimum cut-off position wherein said one or more cut off plates are substantially parallel to said optical axis as the magnification of the projection means increases.

11. The image projecting device of claim 1, wherein there is further provided an image-irradiating means for scanning an original image with a light source having a light distribution in a lenghtwise direction of the slit, the light distribution of the light source is so determined as to cause the light distribution on said image forming plane to be flat at a specific magnification while positioning said optical cut off plate being parallel to optical axis of the optical path, whereby the cut off amount of luminous fluxes of the image light is made substantially nil, and wherein the dimension of said optical cut off plate is so determined as to make the light distribution on said image forming plane to be flat at other magnification except the specific magnification while positioning said optical cut off plate so as to have an angle to the optical axis of the optical path.

12. The image projecting device of claim 11, the other magnification is smaller than the specific magnification.

13. The image projecting device of claim 11, wherein the other magnification is larger than the specific magnification.

14. The image projecting device of claim 11, wherein the other magnification consists of two magnifications of which the one is smaller than the specific magnification and the another one is larger than the specific magnification.

15. An image projecting device comprising:

optical path regulating means having a slit for passing an image light therethrough, the image light having an optical path and a sectional plane corresponding to the shape of the slit;

projecting means having a lens for projecting the image light, said projecting means capable of changing a projection magnification in accordance with a magnification input;

an image forming plane for forming an optical image corresponding to the projected image light;

a first optical cut off plate being located along the optical path of the image light and having a curved side shaped so as to make the light distribution on said image projection plane flat;

a second optical cut off plate being located along the optical path of the image light and having a flat side shaped so as to reduce evenly the light amount on said image projection plane; and wherein both said first optical cut off plate and second optical cut off plate turn perpendicular to the optical path in accordance with the inputted magnification, so that despite the variation of the projection magnification, the light distribution on said image projection magnification plane is kept to be same level.

16. An image projecting device comprising:

light path regulating means having a slit for passing an image light therethrough, the image light having an optical path and a sectional plane corresponding to the shape of the slit;

projecting means having a lens for projecting the image light, said projecting means capable of changing a projection magnification in accordance with a magnification input;

an image forming plane for forming an optical image corresponding to the projected image light;

a first optical cut off plate being located at a side of the optical path of the image light and having a curved side shaped so as to make the light distribution on said image projection plane flat;

a second optical cut off plate being located at a side of the optical path of the image light and having a flat side shaped so as to reduce evenly the light amount on said image projection plane; and wherein both said first optical cut off plate and second cut off plate are capable of being turned so as to regulate the shape of the optical path in accordance with the inputted magnification, the light distribution on said image projection plane is constant and the light amount on said image projection plane is at a constant level.

* * * * *